US009587646B2

(12) United States Patent
Swiatek et al.

(10) Patent No.: US 9,587,646 B2
(45) Date of Patent: Mar. 7, 2017

(54) CENTRIFUGAL COMPRESSOR DIFFUSER VANELET

(71) Applicant: Ingersoll-Rand Company, Davidson, NC (US)

(72) Inventors: Chester V. Swiatek, Williamsville, NY (US); Mikhail Grigoriev, East Amherst, NY (US); James Hitt, Grand Island, NY (US); Noel Blair, Grand Island, NY (US)

(73) Assignee: Ingersoll-Rand Company, Davidson, NC (US)

( * ) Notice: Subject to any disclaimer, the term of this patent is extended or adjusted under 35 U.S.C. 154(b) by 855 days.

(21) Appl. No.: 13/975,283

(22) Filed: Aug. 23, 2013

(65) Prior Publication Data

US 2014/0064953 A1 Mar. 6, 2014

Related U.S. Application Data

(63) Continuation of application No. 12/701,446, filed on Feb. 5, 2010, now Pat. No. 8,602,728.

(51) Int. Cl.
*F04D 29/44* (2006.01)
*F04D 29/66* (2006.01)

(52) U.S. Cl.
CPC ..... *F04D 29/44* (2013.01); *F04D 29/444* (2013.01); *F04D 29/666* (2013.01); *F05D 2250/52* (2013.01)

(58) Field of Classification Search
CPC ..... F04D 29/44; F04D 29/444; F04D 29/666; F05D 2250/52
(Continued)

(56) References Cited

U.S. PATENT DOCUMENTS 2,372,880 A 4/1945 Browne
4,054,398 A 10/1977 Penny
(Continued)

FOREIGN PATENT DOCUMENTS

DE 3424925 C1 10/1985
DE 4438611 2/1998
(Continued)

OTHER PUBLICATIONS

European Patent Office, International Search Report and Written Opinion issued in corresponding application No. PCT/US2010/058429, mailed on Apr. 6, 2011, 8 pp.

*Primary Examiner* — Ninh H Nguyen
*Assistant Examiner* — Aaron R Eastman
(74) *Attorney, Agent, or Firm* — Taft Stettinius & Hollister LLP

(57) ABSTRACT

A system, in certain embodiments, includes a centrifugal compressor diffuser including a flow path having a first surface and a second surface defining opposite axial sides of the flow path. The centrifugal compressor diffuser also includes multiple vanes extending from the first surface to the second surface of the flow path. A first profile of each vane varies along an axial direction. The centrifugal compressor diffuser further includes multiple vanelets extending from the first surface toward the second surface in the axial direction. A first axial extent of each vanelet is less than a second axial extent of the flow path. In addition, a second profile of each vanelet varies along the axial direction and/or the vanelets form a non-periodic pattern around a circumference of the flow path.

21 Claims, 19 Drawing Sheets

(58) Field of Classification Search
USPC ..... 415/203
See application file for complete search history.

(56) References Cited

U.S. PATENT DOCUMENTS

| | | | | | |
|---|---|---|---|---|---|
| 4,824,325 | A * | 4/1989 | Bandukwalla | F04D 29/444 | 415/208.4 |
| 4,859,145 | A * | 8/1989 | Sidransky | F04D 29/444 | 415/211.1 |
| 4,877,370 | A * | 10/1989 | Nakagawa | F04D 29/444 | 415/148 |
| 4,877,373 | A * | 10/1989 | Bandukwalla | F04D 29/444 | 415/208.4 |
| 5,152,661 | A * | 10/1992 | Sheets | F01D 5/145 | 415/206 |
| 5,165,849 | A * | 11/1992 | Nakagawa | F04D 29/462 | 415/148 |
| 5,310,309 | A * | 5/1994 | Terasaki | F04D 29/444 | 415/208.3 |
| 5,316,441 | A * | 5/1994 | Osborne | F04D 29/444 | 415/208.3 |
| 5,452,986 | A | 9/1995 | Osborne et al. | | |
| 5,516,263 | A * | 5/1996 | Nishida | F04D 29/444 | 415/208.2 |
| 5,529,457 | A * | 6/1996 | Terasaki | F04D 29/444 | 415/208.3 |
| 5,709,531 | A | 1/1998 | Nishida et al. | | |
| 6,554,569 | B2 * | 4/2003 | Decker | F01D 5/141 | 415/192 |
| 7,101,151 | B2 | 9/2006 | Loringer et al. | | |
| 7,448,852 | B2 | 11/2008 | Abdelwahab et al. | | |
| 2005/0232762 | A1 | 10/2005 | Smoke et al. | | |
| 2008/0038114 | A1 | 2/2008 | Abdelwahab et al. | | |

FOREIGN PATENT DOCUMENTS

| | | | |
|---|---|---|---|
| EP | 0538753 | | 4/1993 |
| EP | 1832754 | | 9/2007 |
| GB | 138404 | A | 2/1920 |
| GB | 985743 | A | 3/1965 |
| JP | 5044693 | A | 2/1993 |
| JP | 2002516960 | A | 6/2002 |
| WO | 9961800 | A1 | 12/1999 |
| WO | 2008/023034 | A1 | 2/2008 |

* cited by examiner

CENTRIFUGAL COMPRESSOR DIFFUSER VANELET

CROSS REFERENCE TO RELATED APPLICATION

This application claims priority to and benefit of U.S. patent application Ser. No. 12/701,446, entitled "Centrifugal Compressor Diffuser Vanelet", filed on Feb. 5, 2010, which is herein incorporated by reference in its entirety.

BACKGROUND

This section is intended to introduce the reader to various aspects of art that may be related to various aspects of the present invention, which are described and/or claimed below. This discussion is believed to be helpful in providing the reader with background information to facilitate a better understanding of the various aspects of the present invention. Accordingly, it should be understood that these statements are to be read in this light, and not as admissions of prior art.

Centrifugal compressors may be employed to provide a pressurized flow of fluid for various applications. Such compressors typically include an impeller that is driven to rotate by an electric motor, an internal combustion engine, or another drive unit configured to provide a rotational output. As the impeller rotates, fluid entering in an axial direction is accelerated and expelled in a circumferential and a radial direction. The high-velocity fluid then enters a diffuser which converts the velocity head into a pressure head (i.e., decreases flow velocity and increases flow pressure). The volute or scroll then collects the radially outward flow and directs it into a pipe. In this manner, the centrifugal compressor produces a high-pressure fluid output. The overall compressor efficiency is a function of impeller, diffuser and scroll/volute performance, as well as the interaction between these components.

BRIEF DESCRIPTION OF THE DRAWINGS

Various features, aspects, and advantages of the present invention will become better understood when the following detailed description is read with reference to the accompanying figures in which like characters represent like parts throughout the figures, wherein.

DETAILED DESCRIPTION OF SPECIFIC EMBODIMENTS

Figure 1:
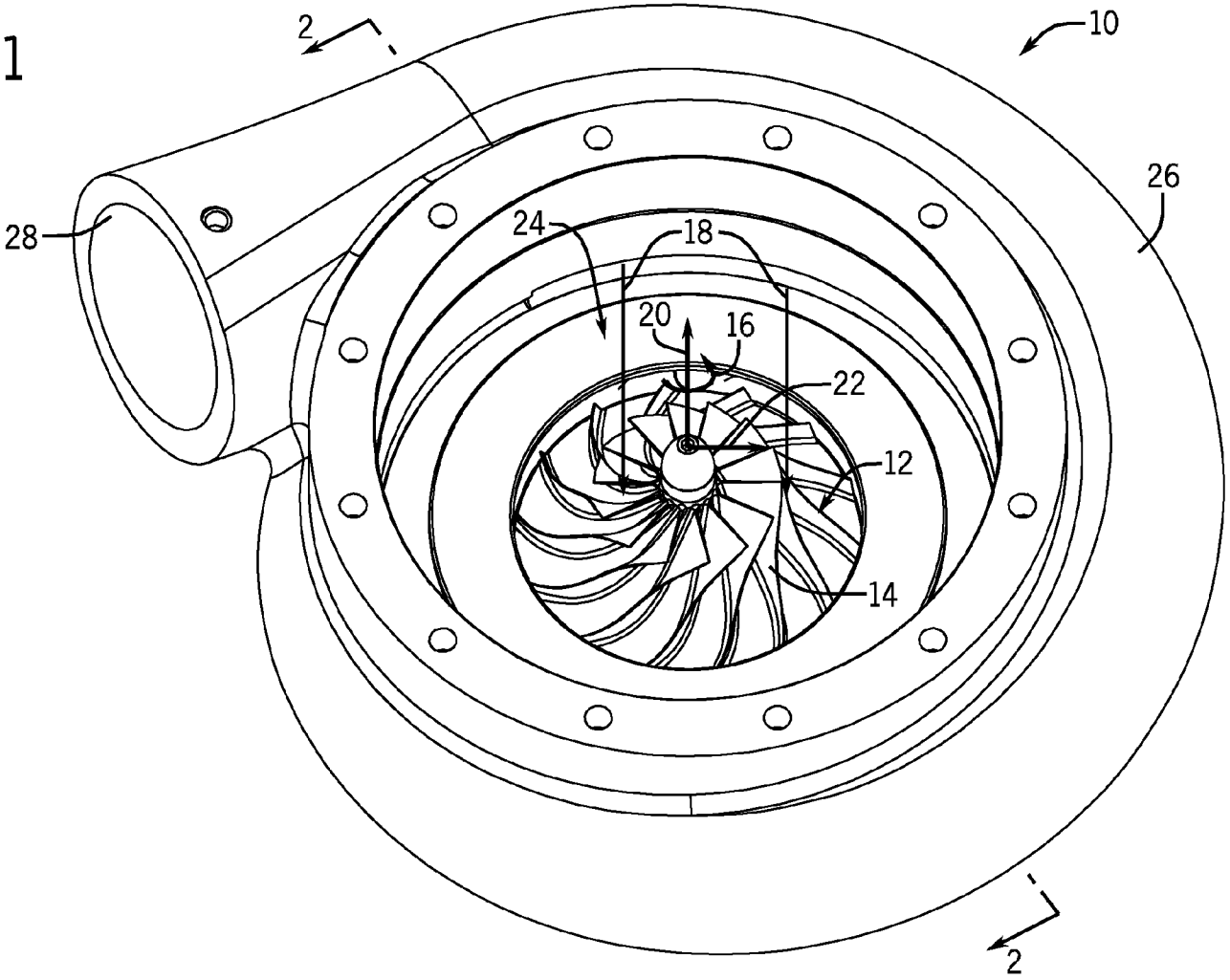
FIG. 1 is a perspective view of a centrifugal compressor including a diffuser having vanelets configured to reduce an incidence angle between fluid flow from an impeller and a leading edge of diffuser vanes in accordance with certain embodiments of the present technique.

One or more specific embodiments of the present invention will be described below. These described embodiments are only exemplary of the present invention. Additionally, in an effort to provide a concise description of these exemplary embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

In certain configurations, a diffuser includes a series of vanes configured to enhance diffuser efficiency. Certain diffusers may include three-dimensional vanes configured to match flow variations from an impeller. For example, an angle of fluid flow from the impeller may vary along an axial direction. Consequently, a leading edge of each vane may be particularly contoured to match the angle of fluid flow, thereby reducing the incidence angle between the fluid flow and the vane. As will be appreciated, the angle of fluid flow adjacent to a shroud-side of the diffuser may be significantly different than the angle of fluid flow throughout the remainder of the axial flow profile. Therefore, it may not be feasible to properly contour the leading edge of each vane to match the angle of fluid flow adjacent to the shroud-side of the diffuser. As a result, the incidence angle may increase within the region adjacent to the shroud, thereby decreasing diffuser efficiency.

Embodiments of the present disclosure may increase diffuser efficiency by employing vanelets to reduce the incidence angle between the fluid flow and the leading edge of the vanes. In the present embodiments, both the vanes and vanelets axially extend into a flow path of the diffuser. The axial extent of the vanes is substantially equal to the axial extent of the flow path. For example, the vanes may extend from a hub side to a shroud side of the flow path. In contrast, the axial extent of the vanelets is less than the axial extent of the flow path. Therefore, vanelets coupled to the shroud side of the flow path do not contact the hub side, and vanelets coupled to the hub side of the flow path do not contact the shroud side. In certain embodiments, a diffuser includes multiple vanelets, in which a profile of each vanelet varies along the axial direction (e.g., three-dimensional vanelets), the vanelets form a non-periodic pattern around a circumference of the flow path (e.g., not circumferentially symmetric), or a combination thereof. The diffuser may also include multiple vanes having a profile that varies along the axial direction (e.g., three-dimensional vanes). The combination of three-dimensional vanes, three-dimensional vanelets and/or non-periodic vanelets may increase diffuser efficiency by substantially matching circumferential and/or axial variations in the fluid flow from the impeller.

FIG. 1 is a perspective view of a centrifugal compressor 10 configured to output a pressurized fluid flow. Specifically, the centrifugal compressor 10 includes an impeller 12 having multiple blades 14. As the impeller 12 is driven to rotate in a circumferential direction 16 by an external source (e.g., electric motor, internal combustion engine, etc.), compressible fluid 18 is drawn into the blades 14 along an axial direction 20. The compressible fluid 18 is then accelerated in a radial direction 22 toward a diffuser 24 disposed about the impeller 12. The diffuser 24 is configured to convert the high-velocity fluid flow from the impeller 12 into a high pressure flow (i.e., convert the dynamic head to pressure head). In certain embodiments, a shroud (not shown) is positioned directly adjacent to the diffuser 24, and serves to direct fluid flow from the impeller 12 to a scroll or volute 26. The scroll 26 includes a chamber configured to collect the compressible fluid 18 and direct it toward an exit orifice 28. In certain configurations, a diameter of the chamber increases along the circumferential direction 16, thereby further converting dynamic head to pressure head.

In the present embodiment, the diffuser 24 may include vanelets configured to redirect fluid flow near an adjacent vane, thereby decreasing an incidence angle between the fluid flow and a leading edge of the vane. For example, the vanelets may properly align the fluid flow with the vane despite axial and/or circumferential variations in the flow field. As will be appreciated, reducing the incidence angle increases the efficiency of the vane, thereby increasing the overall efficiency of the diffuser 24. As a result of this configuration, overall compressor efficiency may increase by more than approximately 0.5, 1, 1.5, or more percent. As discussed in detail below, certain vanelets include a three-dimensional shape to account for variations in incidence angle along the vanelet span. Further embodiments include vanelets circumferentially disposed about the diffuser flow path in a non-periodic arrangement to compensate for circumferential variations in the flow field due to the presence of the scroll 26.

Figure 2:
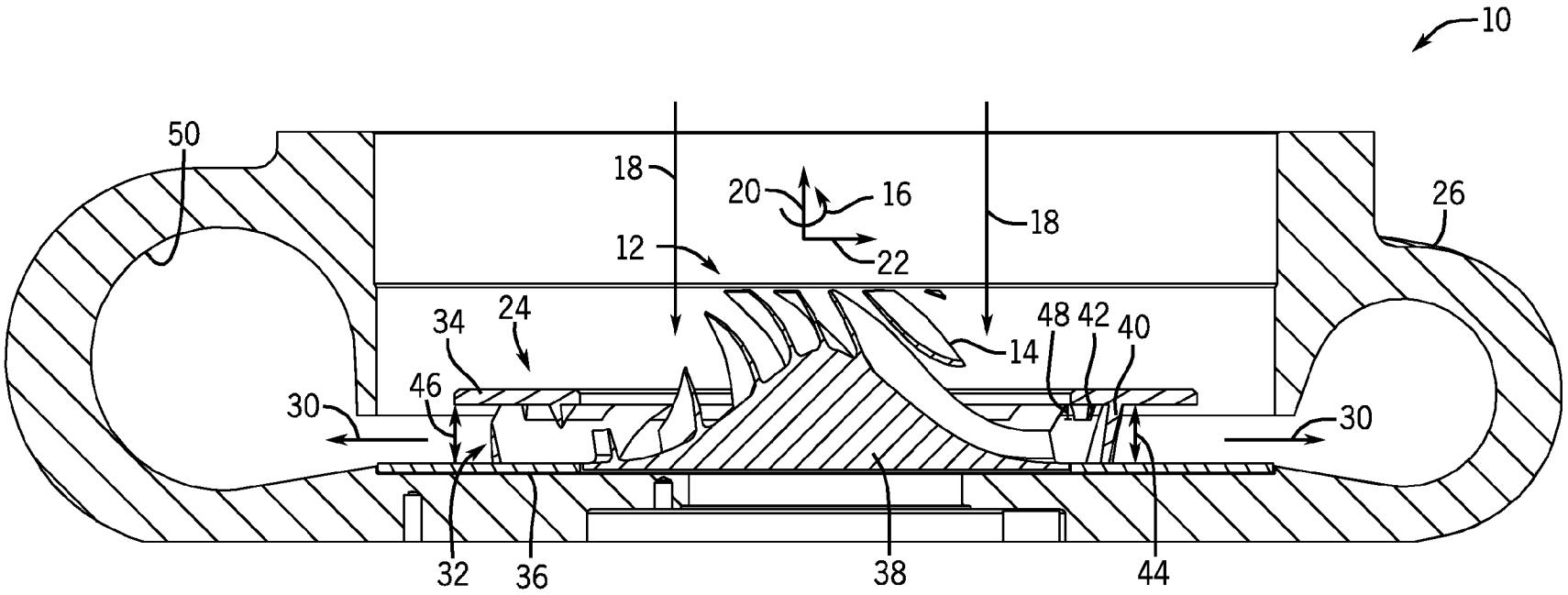
FIG. 2 is a cross-sectional view of the centrifugal compressor, taken along line 2-2 of FIG. 1, in accordance with certain embodiments of the present technique.

FIG. 2 is a cross-sectional view of the centrifugal compressor 10, taken along line 2-2 of FIG. 1. As previously discussed, the compressible fluid 18 flows into the impeller 12 along the axial direction 20, and is accelerated in the radial direction 22 toward the diffuser 24. The diffuser 24 converts the dynamic head into pressure head, thereby establishing a flow of high pressure fluid 30 into the scroll 26. Specifically, the fluid 30 passes through a diffuser flow path 32 defined by a shroud-side mounting surface 34 on a first axial side and a hub-side mounting surface 36 on an opposite axial side. As illustrated, the hub-side mounting surface 36 is positioned adjacent to a hub 38 of the impeller 12. Similarly, the shroud-side mounting surface 34 is positioned adjacent to the shroud (not shown).

In the illustrated embodiment, the diffuser 24 includes a series of vanes 40 and vanelets 42 configured to increase the efficiency of the diffuser 24. As discussed in detail below, the vanes 40 and/or vanelets 42 are circumferentially disposed about the flow path 32 in an annular arrangement. As illustrated, an axial extent 44 of each vane 40 is equal to an axial extent 46 of the flow path 32, i.e., from the shroud-side mounting surface 34 to the hub-side mounting surface 36. The vanes 40 may be secured to the shroud-side mounting surface 34, the hub-side mounting surface 36, or both mounting surfaces 34 and 36.

In contrast to the vanes 40, an axial extent 48 of the vanelets 42 is less than the axial extent 46 of the flow path 32. For example, in certain embodiments, the axial extent 48 of the vanelets 42 may be less than approximately 50, 45, 40, 35, 30, 25, 20, 15, 10, 5 percent, or less, of the axial extent 46 of the flow path 32. In the present embodiment, the vanelets 42 are mounted to the shroud-side mounting surface 34. However, in alternative embodiments, the vanelets 42 may be mounted to the hub-side mounting surface 36.

As discussed in detail below, the vanelets 42 may be configured to redirect the flow of fluid 30 from the impeller to reduce an incidence angle between a leading edge of the vanes 40 and the flow field. Consequently, diffuser efficiency may be increased compared to configurations which do not include the vanelets 42. In addition, because the vanelets 42 do not traverse the entire axial extent of the flow path 32, the vanelets 42 may improve choked flow performance compared to full-height vanes. Furthermore, the decreased axial extent of the vanelets 42 may reduce the possibility of reflecting pressure waves back toward the impeller 12, which may lead to rotordynamic instability.

Figure 3:
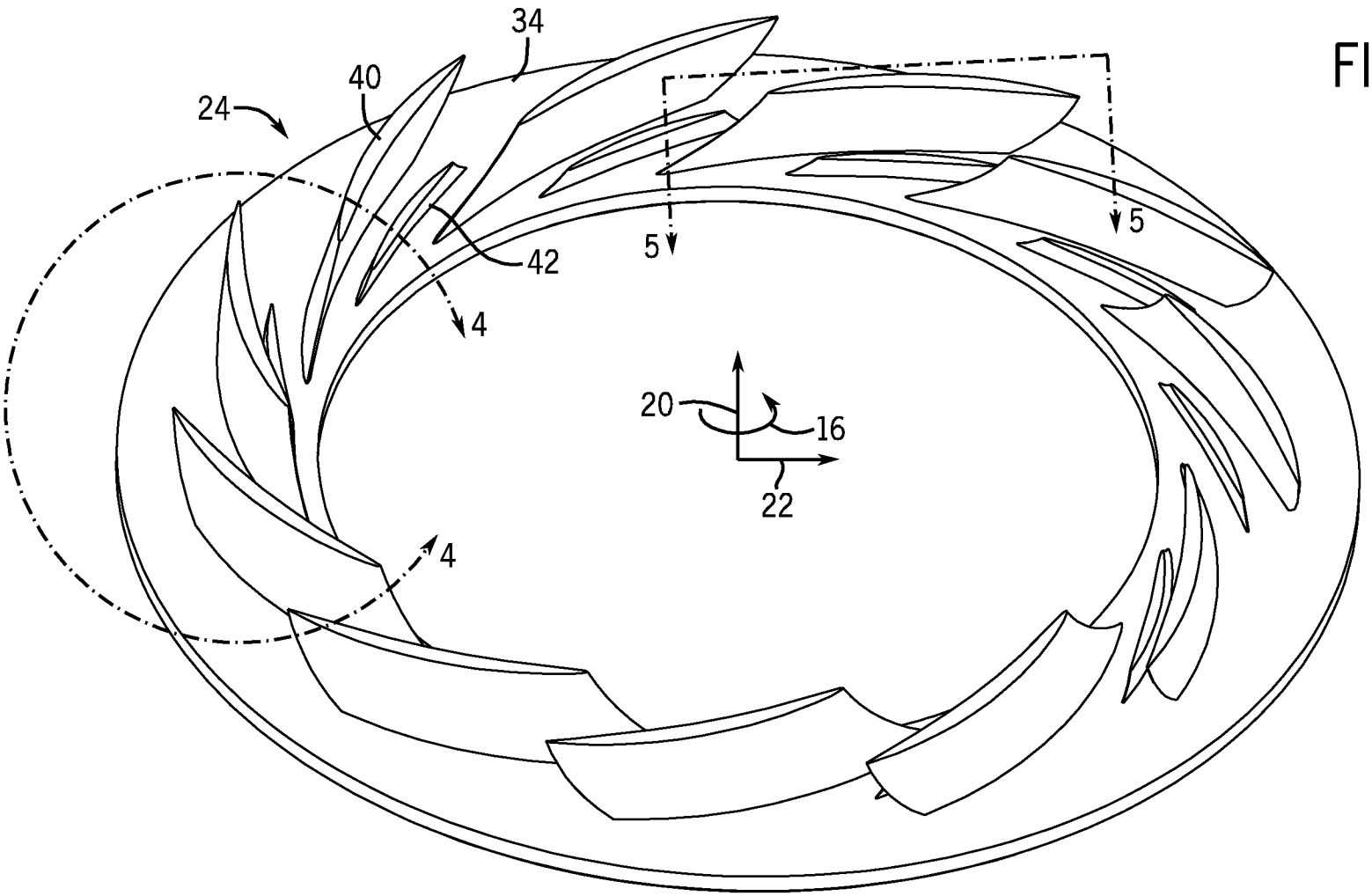
FIG. 3 is a perspective view of a diffuser that may be utilized within the centrifugal compressor of FIG. 1, illustrating multiple vanes and vanelets circumferentially disposed about a shroud-side mounting surface in accordance with certain embodiments of the present technique.

FIG. 3 is a perspective view of the diffuser 24, illustrating multiple vanes 40 and vanelets 42 disposed about the shroud-side mounting surface 34 along the circumferential direction 16. As previously discussed, both the vanes 40 and vanelets 42 extend in the axial direction 20 from the shroud-side mounting surface 34. Furthermore, while the vanes 40 and vanelets 42 are shown attached to the shroud-side mounting surface 34, it should be appreciated that in alternative embodiments vanes 40 and/or vanelets 42 may be coupled to the hub-side mounting surface 36, or a combination of shroud-side and hub-side mounting surfaces 34 and 36 (e.g., some vanes 40 and/or vanelets 42 coupled to the shroud-side mounting surface 34, and other vanes 40 and/or vanelets 42 coupled to the hub-side mounting surface 36). In the present configuration, each vane 40 includes a profile that varies along the axial direction 20, thereby forming a three-dimensional (3D) vane 40. It should be appreciated that alternative embodiments may employ two-dimensional (2D) vanes having profiles that remain constant along the axial direction 20. Similarly, the present configuration employs three-dimensional vanelets 42. However, as discussed in detail below, alternative embodiments may employ two-dimensional vanelets.

As illustrated, the present embodiment employs 11 vanes 40 and an equal number of vanelets 42. It should be appreciated that alternative embodiments may employ more or fewer vanes 40 and/or vanelets 42. For example, certain configurations may utilize 1, 2, 3, 4, 5, 6, 7, 8, 9, 10, 11, 12, 13, 14, 15, 16, or more vanes 40. Similarly, 1, 2, 3, 4, 5, 6, 7, 8, 9, 10, 11, 12, 13, 14, 15, 16, or more vanelets 42 may be employed. While the number of vanes 40 and vanelets 42 are equal in the present configuration, it should be appreciated that alternative configurations may employ more vanes 40 than vanelets 42, or more vanelets 42 than vanes 40. For example, in certain configurations two or more vanelets 42 may be positioned between each vane 40. In alternative configurations, the number of vanelets 42 between each vane 40 may vary along the circumferential direction 16. For example, certain pairs of vanes 40 may include 0, 1, 2, 3, 4, or more vanelets 42 disposed between them.

As illustrated, the present diffuser 24 includes vanes 40 and vanelets 42 arranged in a periodic configuration. As discussed in detail below, in a periodic configuration, the vanes 40 and vanelets 42 are symmetrically disposed about the shroud-side mounting surface 34 along the circumferential direction 16. Alternative configurations may employ non-periodic vanes 40 and/or non-periodic vanelets 42. In either a periodic or non-periodic configuration, the vanelets 42 serve to redirect flow from the impeller, thereby decreasing an incidence angle between the flow field and the vanes 40. Such a configuration may increase the efficiency of the diffuser 24 compared to diffusers having only vanes which extend along the entire axial extent of the flow path.

Figure 4:
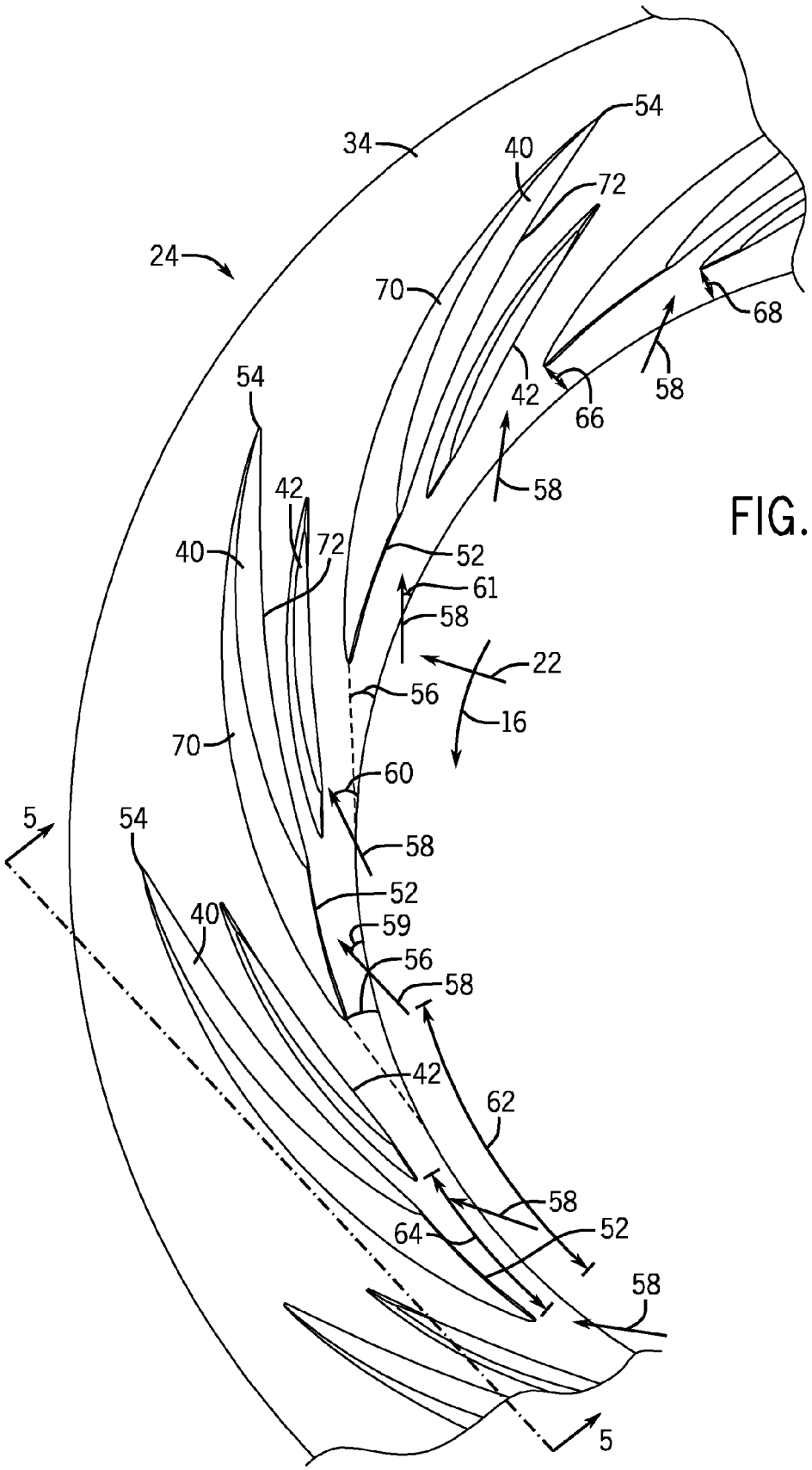
FIG. 4 is a partial axial view of a portion of the diffuser, taken within line 4-4 of FIG. 3, depicting fluid flow through the diffuser in accordance with certain embodiments of the present technique.

FIG. 4 is a partial axial view of a portion of the diffuser 24, taken within line 4-4 of FIG. 3, showing fluid flow expelled from the impeller 12. As illustrated, each vane 40 includes a leading edge 52 and a trailing edge 54. As discussed in detail below, fluid flow from the impeller 12 flows from the leading edge 52 to the trailing edge 54, thereby converting dynamic pressure (i.e., flow velocity) into static pressure (i.e., pressurized fluid). In the present embodiment, the leading edge 52 of each vane 40 is oriented at an angle 56 with respect to the circumferential axis 16. As illustrated, the circumferential axis 16 follows the curvature of the annular shroud-side mounting surface 34. Therefore, a 0 degree angle 56 would result in a leading edge 52 oriented substantially tangent to the curvature of the surface 34. In certain embodiments, the angle 56 may be approximately between 0 to 60, 5 to 55, 10 to 50, 15 to 45, 15 to 40, 15 to 35, or about 10 to 30 degrees. In the present embodiment, the angle 56 of each vane 40 may vary between approximately 17 to 24 degrees. However, alternative configurations may employ vanes 40 having different orientations relative to the circumferential axis 16.

As illustrated, fluid flow 58 exits the impeller in both the circumferential direction 16 and the radial direction 22. An angle of the fluid flow 58 with respect to the circumferential axis 16 may vary along the circumferential direction 16. For example, at one circumferential position, the fluid flow 58 is oriented at an angle 59, while at a second circumferential position, the fluid flow 58 is oriented at an angle 60. In addition, the fluid flow 58 is oriented at an angle 61 at a third circumferential position. While three angles 59, 60 and 61 are shown, it should be appreciated that the fluid flow angle may vary continuously along the circumferential direction 16. Furthermore, it should be appreciated that the magnitude of the flow velocity may vary with circumferential position as well. Moreover, both the velocity magnitude and direction may vary with time, where the illustrated fluid flow 58 represents a time-averaged flow field.

As will be appreciated, the angles 59, 60 and 61 may vary based on impeller configuration, impeller rotation speed, and/or flow rate through the compressor 10, among other factors. In the present configuration, the angle 56 of the vanes 40 is particularly configured to match the direction of fluid flow 58 from the impeller 12. As will be appreciated, a difference between the leading edge angle 56 and the fluid flow angle 59, 60 or 61 may be defined as an incidence angle. The vanes 40 of the present embodiment are configured to substantially reduce the incidence angle, thereby increasing the efficiency of the centrifugal compressor 10. As a result, the angle 56 of each vane 40 may be particularly adjusted to match the time-averaged angle 59, 60 or 61 of the fluid flow 58 at a circumferential position corresponding to the circumferential position of the vane 40.

As previously discussed, the vanes 40 are disposed about the shroud-side mounting surface 34 in a substantially annular arrangement. A spacing 62 between vanes 40 along the circumferential direction 16 may be configured to provide efficient conversion of the velocity head to pressure head. In the present configuration, the spacing 62 between vanes 40 is substantially equal. However, alternative embodiments may employ uneven vane spacing. In addition, a spacing 64 between the vanes 40 and the vanelets 42 may serve to redirect the fluid flow adjacent to the shroud-side mounting surface 34, thereby decreasing the incidence angle and increasing the efficiency of the diffuser 24. In the present configuration, the spacing 64 is substantially equal between each vane 40 and vanelet 42. However, alternative embodiments may employ uneven vane 40/vanelet 42 spacing. Furthermore, in the present embodiment, a radial position 66 of each vane 40 is substantially equal to a radial position 68 of each vanelet 42. However, alternative embodiments may employ vanes 40 and vanelets 42 having different radial positions 66 and 68.

Each vane 40 includes a pressure surface 70 and a suction surface 72. As will be appreciated, as the fluid flows from the leading edge 52 to the trailing edge 54, a high pressure region is induced adjacent to the pressure surface 70 and a lower pressure region is induced adjacent to the suction surface 72. These pressure regions affect the flow field from the impeller 12, thereby increasing flow stability and efficiency compared to vaneless diffusers. In the present embodiment, each three-dimensional vane 40 is particularly configured to match the flow properties of the impeller 12, thereby providing increased efficiency.

In addition to variations in fluid flow velocity in the circumferential direction 16, the direction and/or magnitude of the fluid flow velocity may vary along the axial direction 20. Consequently, the angle 56 of the vane 40 relative to the circumferential axis 16 may vary along the axial direction 20 to substantially match the direction of fluid flow. However, the angle of fluid flow adjacent to the shroud side of the diffuser 24 may be significantly different than the angle of fluid flow throughout the remainder of the axial flow profile. Therefore, the present embodiment employs vanelets 42 adjacent to the vanes 40 to redirect the fluid flow adjacent to the shroud-side mounting surface 34, thereby decreasing the incidence angle and increasing the efficiency of the diffuser 24.

Figure 5:
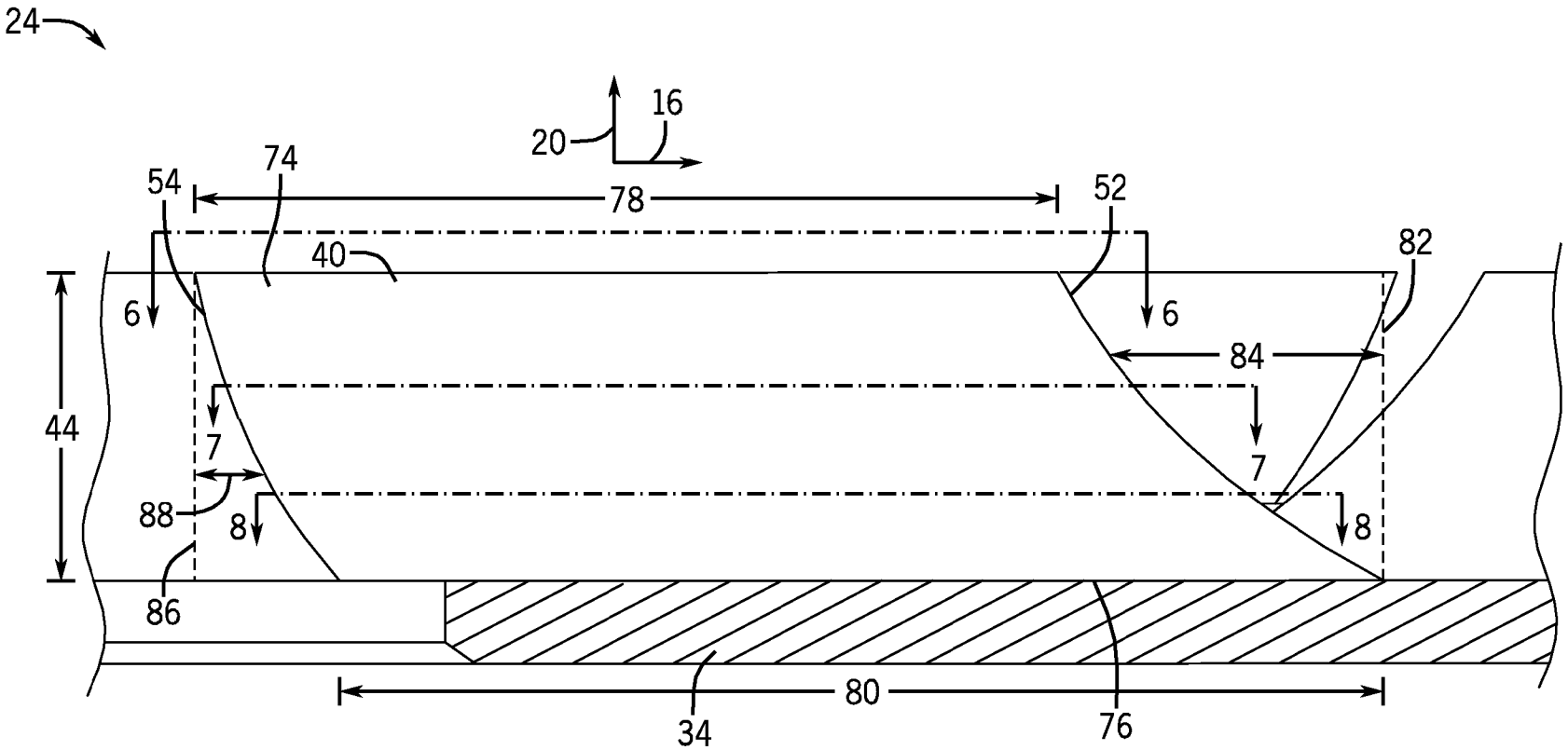
FIG. 5 is a meridional view of the diffuser, taken along line 5-5 of FIG. 3, depicting a diffuser vane profile in accordance with certain embodiments of the present technique.

FIG. 5 is a meridional view of the diffuser 24, taken along line 5-5 of FIG. 3, depicting a diffuser vane profile. Each vane 40 extends along the axial direction 20 between the shroud-side mounting surface 34 and the hub-side mounting surface 36, forming an axial extent or span 44. Specifically, the span 44 is defined by a vane root 74 on the hub side and a vane tip 76 on the shroud side. As discussed in detail below, a meridional length of the vane 40 is configured to vary along the span 44. The meridional length is the distance between the leading edge 52 and the trailing edge 54 at a particular axial position along the vane 40. For example, a length 78 of the vane root 74 may vary from a length 80 of the vane tip 76. A meridional length for an axial position (i.e., position along the axial direction 20) of the vane 40 may be selected based on fluid flow characteristics at that particular axial location. For example, computer modeling may determine that fluid velocity from the impeller 12 varies in the axial direction 20. Therefore, the length for each axial position may be particularly selected to correspond to the incident fluid velocity. In this manner, efficiency of the vane 40 may be increased compared to configurations in which the length remains substantially constant along the span 44 of the vane 40.

In addition, a circumferential position (i.e., position along the circumferential direction 16) of the leading edge 52 and/or trailing edge 54 may be configured to vary along the span 44 of the vane 40. As illustrated, a reference line 82 extends from the leading edge 52 of the vane tip 76 to the hub-side mounting surface 36 along the axial direction 20. The circumferential position of the leading edge 52 along the span 44 is offset from the reference line 82 by a variable distance 84. In other words, the leading edge 52 is variable rather than constant in the circumferential direction 16. This configuration establishes a variable distance between the impeller 12 and the leading edge 52 of the vane 40 along the span 44. For example, based on computer simulation of fluid flow from the impeller 12, a particular distance 84 may be selected for each axial position along the span 44. In this manner, efficiency of the vane 40 may be increased compared to configurations employing a constant distance 84. In the present embodiment, the distance 84 increases as distance from the vane tip 76 increases. Alternative embodiments may employ other leading edge profiles, including arrangements in which the leading edge 52 extends past the reference line 82 along a direction toward the impeller 12.

Similarly, a circumferential position of the trailing edge 54 may be configured to vary along the span 44 of the vane 40. As illustrated, a reference line 86 extends from the trailing edge 54 of the vane root 74 away from the hub-side mounting surface 36 along the axial direction 20. The circumferential position of the trailing edge 54 along the span 44 is offset from the reference line 86 by a variable distance 88. In other words, the trailing edge 54 is variable rather than constant in the circumferential direction 16. This configuration establishes a variable distance between the impeller 12 and the trailing edge 54 of the vane 40 along the span 44. For example, based on computer simulation of fluid flow from the impeller 12, a particular distance 88 may be selected for each axial position along the span 44. In this manner, efficiency of the vane 40 may be increased compared to configurations employing a constant distance 88. In the present embodiment, the distance 88 increases as distance from the vane root 74 increases. Alternative embodiments may employ other trailing edge profiles, including arrangements in which the trailing edge 54 extends past the reference line 86 along a direction away from the impeller 12. In further embodiments, a radial position of the leading edge 52 and/or a radial position of the trailing edge 54 may vary along the span 44 of the diffuser vane 40.

Figure 6:
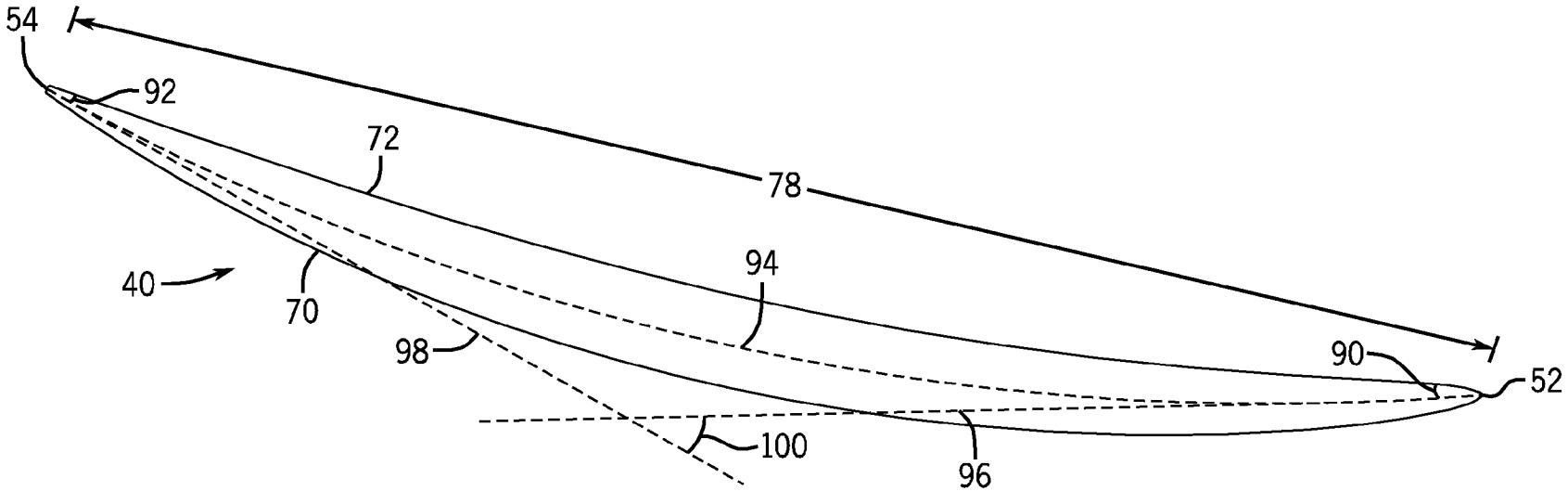
FIG. 6 is a top view of a diffuser vane profile, taken along line 6-6 of FIG. 5, in accordance with certain embodiments of the present technique.

FIG. 6 is a top view of a diffuser vane profile, taken along line 6-6 of FIG. 5. As previously discussed, a profile of the vane 40 may vary along the axial direction 20, thereby establishing a three-dimensional vane shape. Specifically, parameters of the vane 40 may be particularly configured to coincide with three-dimensional fluid flow from a particular impeller 12, thereby efficiently converting fluid velocity into fluid pressure. For example, as previously discussed, the meridional length for an axial position (i.e., position along the axial direction 20) of the vane 40 may be selected based on the flow properties at that axial location. As illustrated, the length 78 of the vane root 74 may be selected based on the flow from the impeller 12 at the root 74 of the vane 40.

Furthermore, the leading edge 52 and/or the trailing edge 54 may include a curved profile at the tip of the respective edge. Specifically, a tip of the leading edge 52 may include a curved profile having a radius of curvature 90 configured to direct fluid flow around the leading edge 52. Similarly, a radius of curvature 92 of a tip of the trailing edge 54 may be selected based on computed flow properties at the trailing edge 54. In certain configurations, the radius of curvature 90 of the leading edge 52 may be larger than the radius of curvature 92 of the trailing edge 54. In alternative configurations, the radius of curvature 90 of the leading edge 52 may be smaller than the radius of curvature 92 of the trailing edge 54.

Another vane property that may affect fluid flow through the diffuser 24 is the curvature of the vane 40. As illustrated, a mean vane sectional line 94 extends from the leading edge 52 to the trailing edge 54 and defines the center of the vane profile (i.e., the center line between the pressure surface 70 and the suction surface 72). The mean vane sectional line 94 illustrates the curved profile of the vane 40. Specifically, a leading edge tangent line 96 extends from the leading edge 52 and is tangent to the mean vane sectional line 94 at the leading edge 52. Similarly, a trailing edge tangent line 98 extends from the trailing edge 54 and is tangent to the mean vane sectional line 94 at the trailing edge 54. A curvature angle 100 is formed at the intersection between the tangent line 96 and tangent line 98. As illustrated, the larger the curvature of the vane 40, the larger the curvature angle 100. Therefore, the angle 100 provides an effective measurement of the curvature of the vane 40. The curvature angle 100 may be selected to provide an efficient conversion from dynamic head to pressure head based on flow properties from the impeller 12. For example, the curvature angle 100 may be greater than approximately 0, 5, 10, 15, 20, 25, 30, or more degrees.

The curvature angle 100, the radius of curvature 90 of the leading edge 52, the radius of curvature 92 of the trailing edge 54 and/or the length 78 may vary along the span 44 of the vane 40. Specifically, each of the above parameters may be particularly selected for each axial cross section based on computed flow properties at the corresponding axial location. In this manner, a three-dimensional vane 40 (i.e., a vane 40 having a variable cross section geometry or profile) may be constructed that provides increased efficiency compared to a two-dimensional vane (i.e., a vane having a constant cross section geometry).

Figure 7:
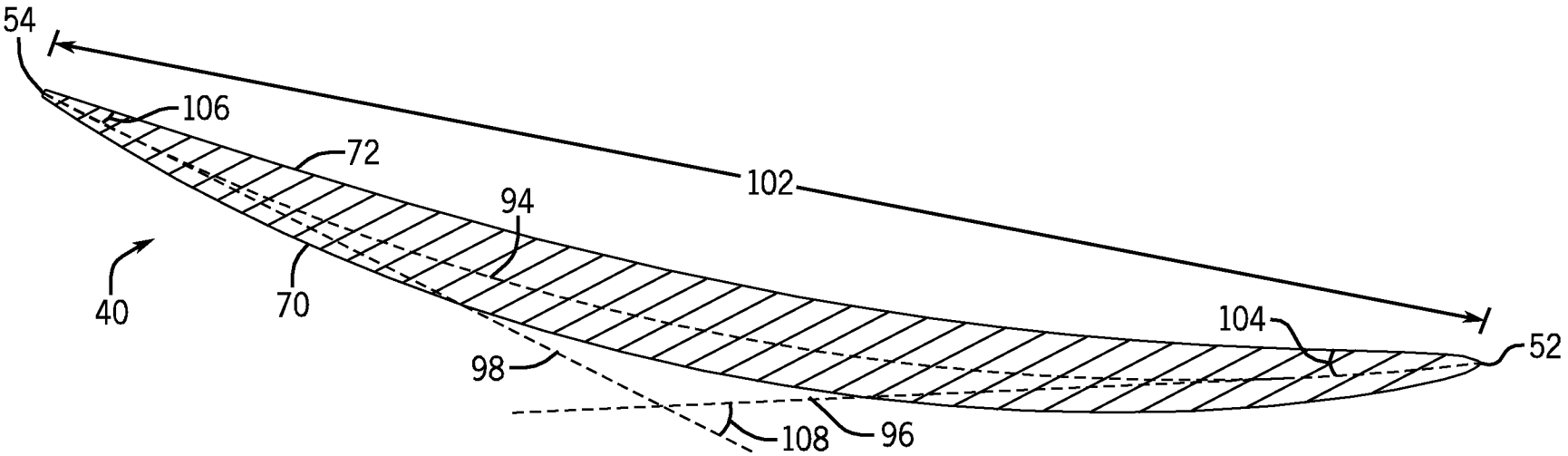
FIG. 7 is a cross section of a diffuser vane, taken along line 7-7 of FIG. 5, in accordance with certain embodiments of the present technique.

FIG. 7 is a cross section of a diffuser vane 40, taken along line 7-7 of FIG. 5. As illustrated, the profile of the vane 40 has been altered to coincide with the flow properties at the axial location corresponding to the present section. For example, the meridional length 102 of the present section may vary from the length 78 of the vane root 74. Similarly, a radius of curvature 104 of the leading edge 52, a radius of curvature 106 of the trailing edge 54, and/or the curvature angle 108 may vary between the illustrated section and the section shown in FIG. 6. For example, the radius of curvature 104 of the leading edge 52 may be particularly selected to reduce the incidence angle between the fluid flow from the impeller 12 and the leading edge 52. As previously discussed, the angle of the fluid flow from the impeller 12 may vary along the axial direction 20. Because the present embodiment facilitates selection of a radius of curvature 104 at each axial position (i.e., position along the axial direction 20), the incidence angle may be substantially reduced along the span 44 of the vane 40, thereby increasing the efficiency of the vane 40 compared to configurations in which the radius of curvature 104 of the leading edge 52 remains substantially constant throughout the span 44. In addition, because the velocity of the fluid flow from the impeller 12 may vary in the axial direction 20, adjusting the radii of curvature 104 and 106, the length 102, curvature angle 108, or other parameters for each axial section of the vane 40 may facilitate increased efficiency of the entire diffuser 24.

Figure 8:
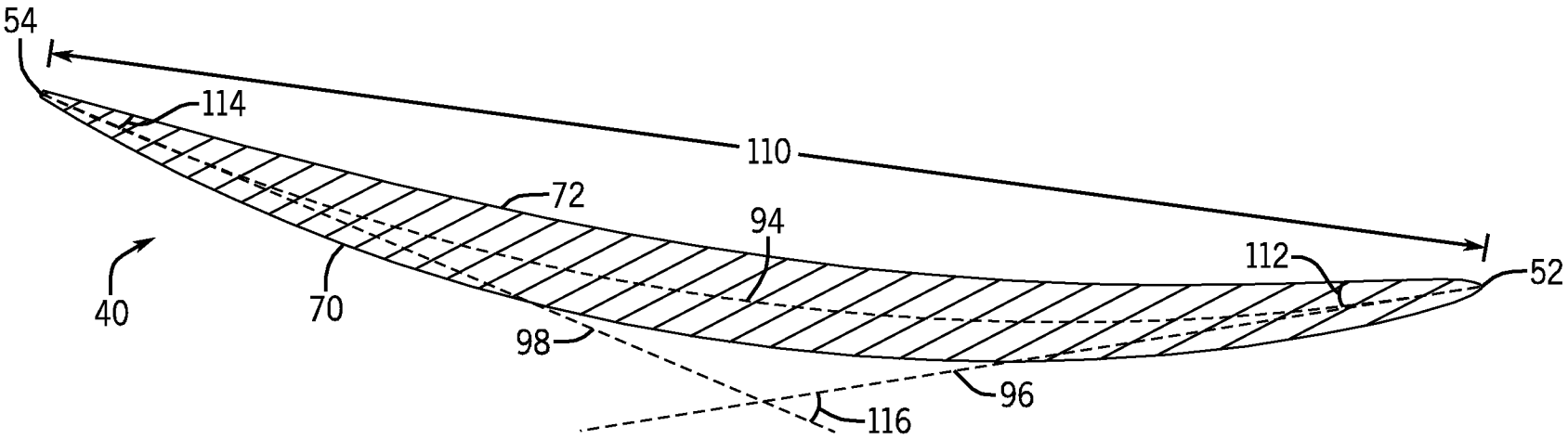
FIG. 8 is a cross section of a diffuser vane, taken along line 8-8 of FIG. 5, in accordance with certain embodiments of the present technique.

FIG. 8 is a cross section of a diffuser vane 40, taken along line 8-8 of FIG. 5. Similar to the section of FIG. 7, the profile of the present section is configured to match the flow properties at the corresponding axial location. Specifically, the present section includes a meridional length 110 that may vary from the lengths 78 and 102 of the sections shown in FIG. 6 and FIG. 7. In addition, a radius of curvature 112 of the leading edge 52, a radius of curvature 114 of the trailing edge 54, and a curvature angle 116 may also be particularly configured for the flow properties (e.g., velocity, incidence angle, etc.) at the present axial location. As previously discussed, the variation in vane profile along the axial direction establishes a three-dimensional vane 40 substantially configured to match the flow field from the impeller 12. However, certain compressors 10 may experience large variations in flow direction within various regions of the flow field (e.g., adjacent to the shroud-side mounting surface 34). Consequently, the present embodiment employs vanelets 42 configured to redirect the flow from the impeller 12 to reduce the incidence angle between the fluid flow and the leading edge 52 of the vane 40, thereby increasing diffuser efficiency.

Figure 9:
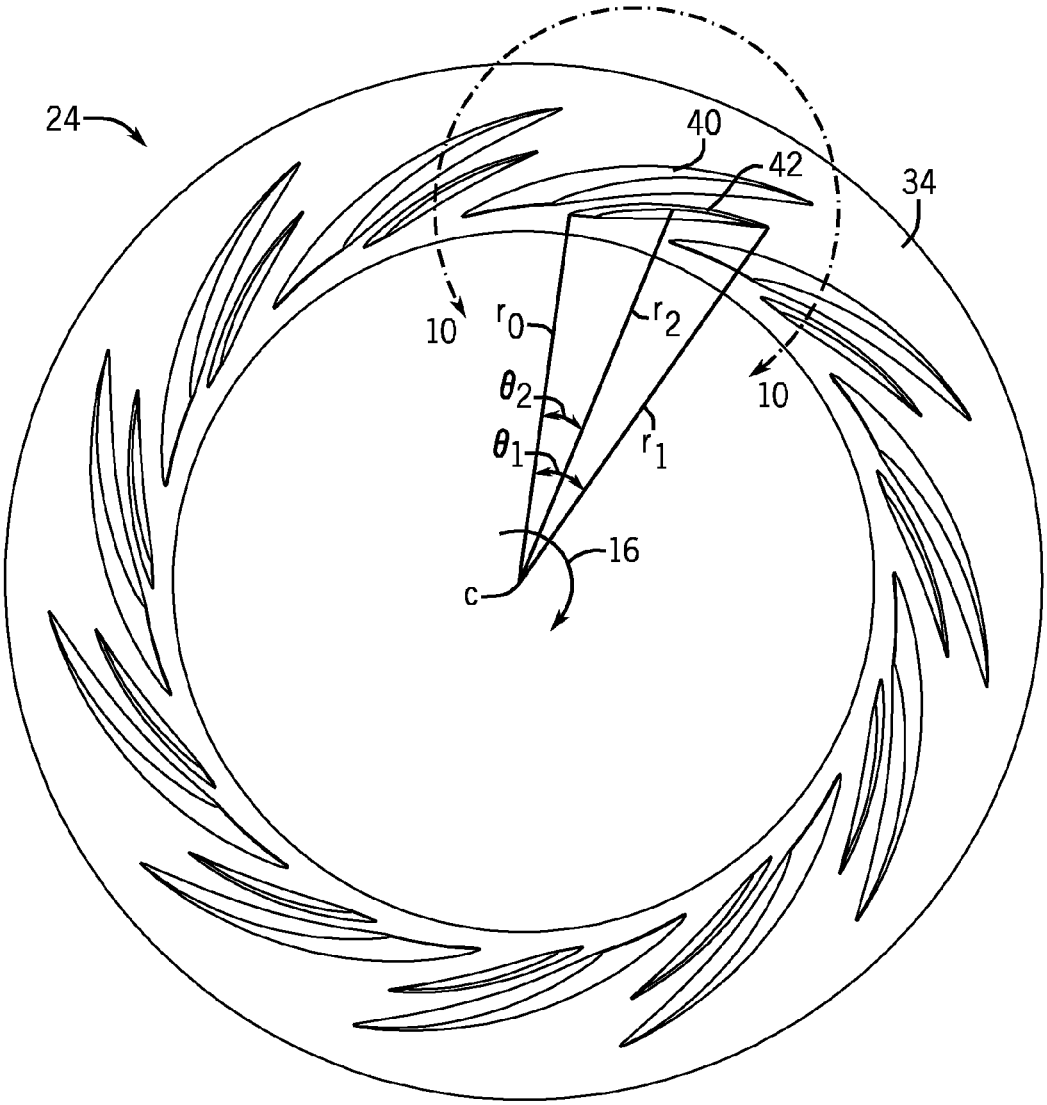
FIG. 9 is an axial view of the diffuser shown in FIG. 3, in which the vanelets are arranged in a periodic configuration in accordance with certain embodiments of the present technique.
Figure 10:
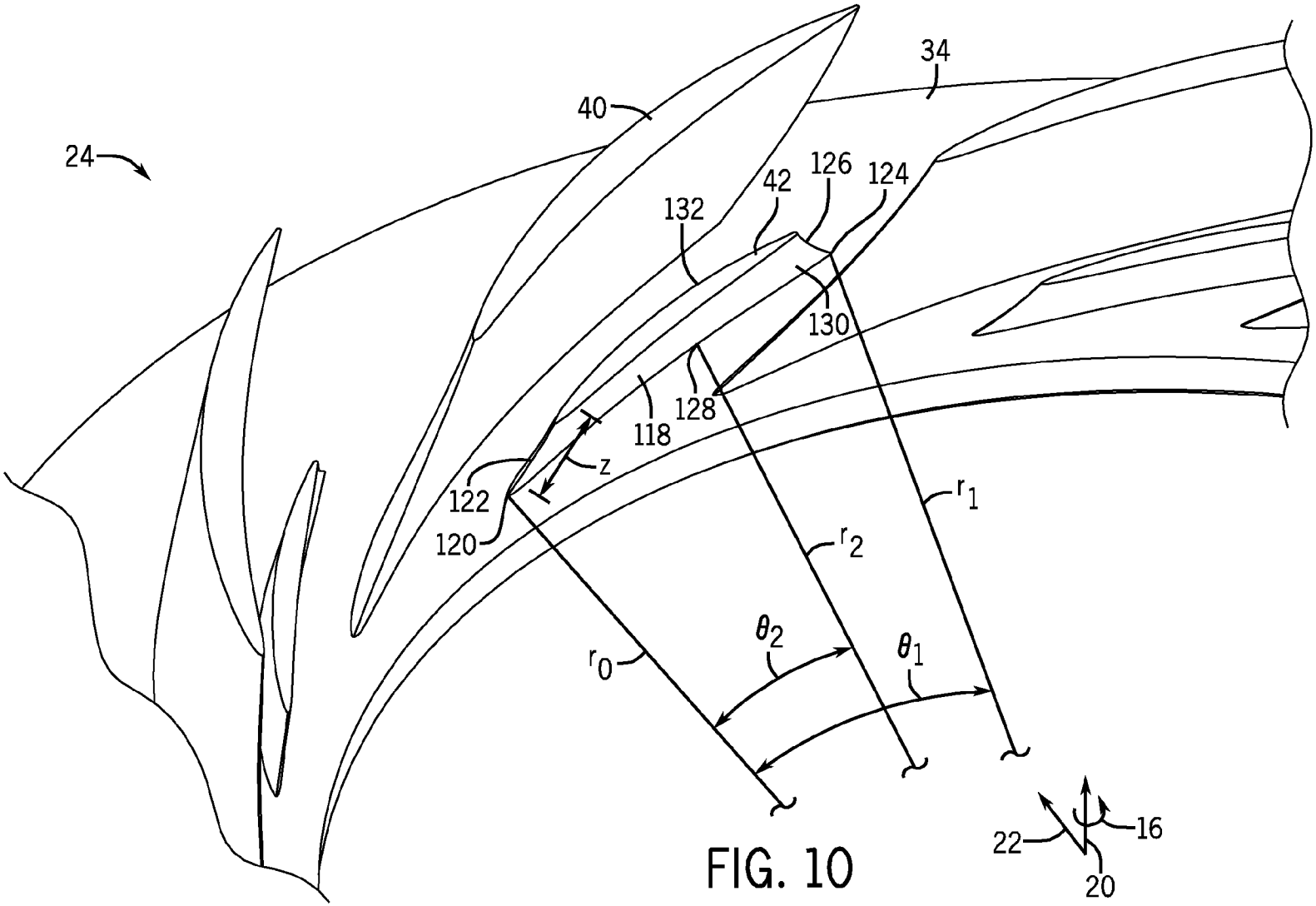
FIG. 10 is a partial perspective view of the diffuser, taken within line 10-10 of FIG. 9, in accordance with certain embodiments of the present technique.

Referring now to FIGS. 9 and 10, FIG. 9 is an axial view of the diffuser 40 shown in FIG. 3, in which the vanelets 42 are arranged in a periodic configuration. As illustrated, the substantially identical vanelets 42 are disposed in a symmetrical (e.g., periodic) pattern along the circumferential direction 16 around a mounting surface, such as the illustrated shroud-side mounting surface 34, of the diffuser 24. As previously discussed, both the vanes 40 and the vanelets 42 are three-dimensional (e.g., have axially varying profiles) in the present embodiment.

FIG. 10 is a partial perspective view of the diffuser 24, taken within line 10-10 of FIG. 9, illustrating a single vanelet 42 which will be used as a reference vanelet. For any given axial height z of each vanelet 42, a reference surface 118 may be defined along a reference plane whose normal coincides with the axial direction 20. In the reference vanelet 42 of FIG. 10, the reference surface 118 is defined by an inner surface of the vanelet 42. However, the analysis described herein may be utilized for any axial height of the vanelet 42. In other words, the reference plane may be defined at any axial height of the vanelets 42. In the illustrated example, the reference plane includes the reference center point c, which passes through the common central axis of the impeller 12, diffuser 24, and scroll 26.

The reference surface 118 may be characterized by a collection of unique points defined by a radial distance r from the reference center point c, an angular location θ, and an axial height z. For any given reference plane, the axial height z for the collection of unique points will be the same. However, the radial distance r and the angular location θ will be different and will define each unique point of the reference surface 118 in the reference plane. For example, a leading edge point 120 corresponding to the leading edge section 122 of the vanelet 42 may be defined as a baseline point of the reference surface 118 and, as such, may be defined by a radial distance $r_0$ and an angular location $\theta_0$ equal to 0 degrees. Similarly, a trailing edge point 124 corresponding to the trailing edge section 126 of the vanelet 42 may be defined by a radial distance $r_1$ and an angular location $\theta_1$. In addition, a suction surface point 128 may be defined by a radial distance $r_2$ and an angular location $\theta_2$. As such, a suction surface 130 of the vanelet 42 may be defined by the plurality of points along the suction surface 130 of the vanelet 42. However, a pressure surface 132 of the vanelet 42 may be similarly defined. Indeed, there may be an infinite number of unique points in the reference surface 118 of the reference vanelet 42 illustrated in FIG. 10. However, the number of unique points used to define the design of the individual vanelets 42 may be limited to facilitate computation of the shape, orientation, and/or location of the vanelets 42.

Furthermore, each vanelet 42 of the diffuser 24 of FIG. 9 may similarly include a collection of unique points along the reference plane. In other words, each of the vanelets 42 may include a two-dimensional area defined by a collection of unique points along the reference plane, such as the reference surface 118 of the reference vanelet 42 illustrated in FIG. 10. Within the periodic arrangement of vanelets 42 of FIGS. 9 and 10, for every point that lies within the two-dimensional domain in the reference plane (e.g., the reference surface 118) of the reference vanelet 42, the rotation of each of these points by an integer multiple of 360.0 divided by N will yield a point that lies within a two-dimensional domain in the reference plane for another vanelet 42, where N is the number of vanelets 42 of the diffuser 24. For example, the diffuser 24 illustrated in FIG. 9 includes 11 vanelets 42. As such, for every point that lies within the two-dimensional domain in the reference plane (e.g., the reference surface 118) of the reference vanelet 42, the rotation of the point by 32.73 degrees, 65.46 degrees, 98.19 degrees, 130.92 degrees, 163.65 degrees, 196.38 degrees, 229.11 degrees, 261.84 degrees, 294.57 and 327.30 degrees (e.g., integer multiples of 360.0 degrees divided by 11, or 32.73 degrees) yields a point that lies within the two-dimensional domain in the reference plane for another diffuser vane 42.

Figure 11:
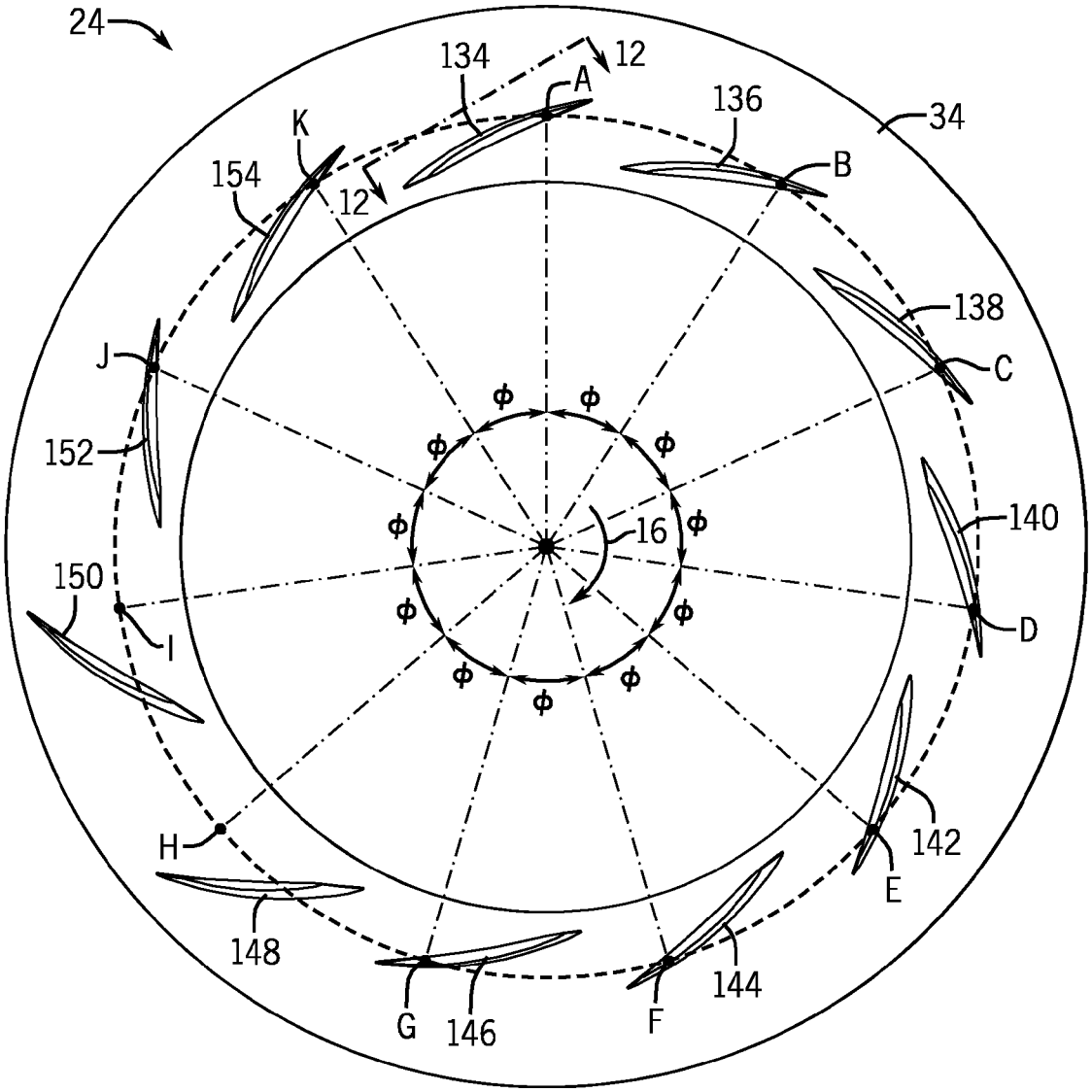
FIG. 11 is an axial view of another embodiment of the diffuser, in which the vanelets are arranged in a non-periodic configuration and the vanes are omitted in accordance with certain embodiments of the present technique.

FIG. 11 is an axial view of another embodiment of the diffuser 24, in which the vanelets are arranged in a non-periodic configuration and the vanes are omitted. In contrast to the periodic vanelet configuration described above with reference to FIGS. 9 and 10, the present diffuser includes vanelets 134, 136, 138, 140, 142, 144, 146, 148, 150, 152 and 154 arranged in a non-periodic (e.g., an asymmetrical) pattern along the circumferential direction 16. As will be appreciated, any set of vanelets that does not meet the circumferentially symmetric transformation requirement described above is considered to be non-periodic. To illustrate the nature of the non-periodic (e.g., an asymmetrical) pattern illustrated in FIG. 11, reference points A, B, C, D, E, F, G, H, I, J and K are located at equally spaced circumferential locations around the shroud-side mounting surface 34. As illustrated, the diffuser 24 includes 11 vanelets 134-154. As such, the reference points A, B, C, D, E, F, G, H, I, J and K are equally spaced at arc angles Φ of 32.73 degrees (e.g., 360.0 degrees divided by 11).

Each of the illustrated vanelets 134, 136, 138, 140, 142, 144, 146, 148, 150, 152 and 154 are generally associated with one of the reference points A, B, C, D, E, F, G, H, I, J and K (e.g., vanelet 134 with reference point A, vanelet 136 with reference point B, vanelet 138 with reference point C, vanelet 140 with reference point D, vanelet 142 with reference point E, vanelet 144 with reference point F, vanelet 146 with reference point G, vanelet 148 with reference point H, vanelet 150 with reference point I, vanelet 152 with reference point J and vanelet 154 with reference point K). The reference points A, B, C, D, E, F, G, H, I, J and K are used to illustrate how the shape, orientation, and/or location of the vanelets 134-154 may change from vanelet to vanelet along the circumferential direction 16 of the shroud-side mounting surface 34.

More specifically, as described above, in order to be considered a periodic (e.g., symmetrical) arrangement of vanelets, for every point that lies within the two-dimensional domain of a vanelet (e.g., a reference vanelet 134) reference plane, the rotation of the point by 32.73 degrees, 65.46 degrees, 98.19 degrees, 130.92 degrees, 163.65 degrees, 196.38 degrees, 229.11 degrees, 261.84 degrees, 294.57 and 327.30 degrees (e.g., integer multiples of 360.0 degrees divided by 11, or 32.73 degrees) would yield a point that lies within the two-dimensional domain of the reference plane of the other vanelets 136, 138, 140, 142, 144, 146, 148, 150, 152 and 154. However, as illustrated, reference points B, C, D, E, F, G, H, I, J and K, which correspond to reference point A rotated through arc angles of 32.73 degrees, 65.46 degrees, 98.19 degrees, 130.92 degrees, 163.65 degrees, 196.38 degrees, 229.11 degrees, 261.84 degrees, 294.57 and 327.30 degrees, do not all lie within the two-dimensional domain of the reference plane for the other vanelets 136, 138, 140, 142, 144, 146, 148, 150, 152 and 154. For example, reference points H and I do not even lie within the corresponding vanelets 148 and 150. As such, the vanelets 134-154 are arranged in a non-periodic configuration within the diffuser 24.

As will be appreciated, the non-periodic configuration of vanelets 134-154 may compensate for circumferential flow variations within the diffuser 24. For example, the scroll 26 may induce circumferential deviations in the direction and/or speed of the fluid flow through the diffuser 24. Consequently, in the present embodiment, the position, number and/or orientation of the vanelets 134-154 may be particularly configured to account for the scroll induced flow variations. As a result, the non-periodic arrangement of vanelets 134-154 may be more efficient than the periodic arrangement described above with reference to the diffuser 24 in FIG. 3.

Figure 12:
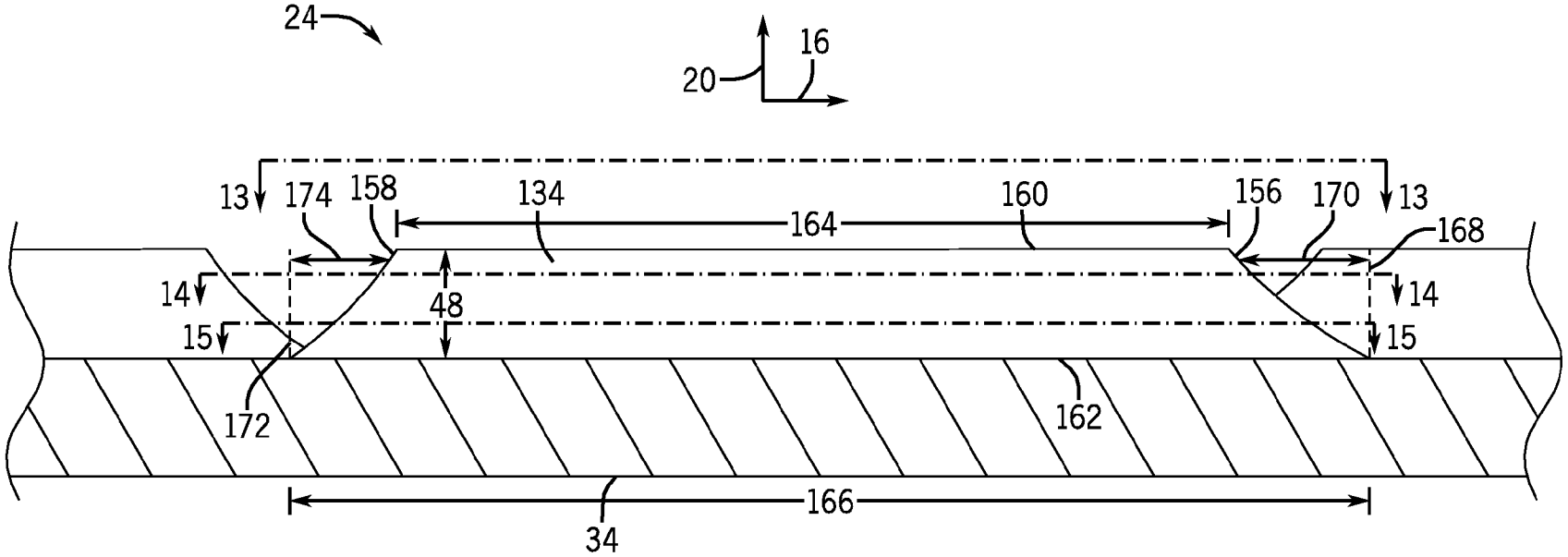
FIG. 12 is a meridional view of the diffuser, taken along line 12-12 of FIG. 11, depicting a diffuser vanelet profile in accordance with certain embodiments of the present technique.

FIG. 12 is a meridional view of the diffuser 24, taken along line 12-12 of FIG. 11, depicting a diffuser vanelet profile. Similar to the diffuser 24 of FIG. 3, the vanelets 134-154 of the present diffuser 24 include cross-sectional profiles that vary along the axial direction 20, thereby establishing a three-dimensional shape. Each vanelet 134-154 extends along the axial direction 20 from the shroud-side mounting surface 34 toward the hub-side mounting surface 36. As previously discussed, the axial extent or span 48 of the vanelets 134-154 is less than the axial extent 46 of the diffuser flow path 32. Furthermore, while an exemplary vanelet 134 is shown extending from the shroud-side mounting surface 34, it should be appreciated that alternative embodiments may include vanelets which extend from the hub-side mounting surface 36. In further embodiments, a diffuser may include vanelets extending from both the shroud-side mounting surface 34 and the hub-side mounting surface 36. While the discussion below describes the shape of an exemplary vanelet 134 of the diffuser 24 shown in FIG. 11, it should be appreciated that the other vanelets 136-154 may have a similar shape. However, in certain configurations, the shape of the vanelets 134-154 may vary based on circumferential position of the respective vanelet.

As illustrated, the span 48 is defined by a vanelet tip 160 on the hub side and a vanelet root 162 on the shroud side. As discussed in detail below, a meridional length of the vanelet 134 is configured to vary along the span 48. The meridional length is the distance between the leading edge 156 and the trailing edge 158 at a particular axial position along the vanelet 134. For example, a length 164 of the vanelet tip 160 may vary from a length 166 of the vanelet root 162. A meridional length for an axial position (i.e., position along the axial direction 20) of the vanelet 134 may be selected based on fluid flow characteristics at that particular axial location. For example, computer modeling may determine that fluid velocity from the impeller 12 varies in the axial direction 20. Therefore, the meridional length for each axial position may be particularly selected to correspond to the incident fluid velocity. In this manner, efficiency of the vanelet 134 may be increased compared to configurations in which the length remains substantially constant along the span 48 of the vanelet 134. Furthermore, in diffuser configurations, such as the diffuser 24 shown in FIG. 3, which include vanes 40 positioned adjacent to the vanelets, the meridional length at each axial position may be particularly configured to decrease an incidence angle between the fluid flow and a leading edge of the respective vane, thereby increasing efficiency of the diffuser 24.

In addition, a circumferential position (i.e., position along the circumferential direction 16) of the leading edge 156 and/or trailing edge 158 may be configured to vary along the span 48 of the vanelet 134. As illustrated, a reference line 168 extends from the leading edge 156 of the vanelet root 162 to the hub side axial extent of the vanelet 134. The circumferential position of the leading edge 156 along the span 48 is offset from the reference line 168 by a variable distance 170. In other words, the leading edge 156 is variable rather than constant in the circumferential direction 16. This configuration establishes a variable distance between the impeller 12 and the leading edge 156 of the vanelet 134 along the span 48. For example, based on computer simulation of fluid flow from the impeller 12, a particular distance 170 may be selected for each axial position along the span 48. In this manner, efficiency of the vanelet 134 may be increased compared to configurations employing a constant distance 170. In addition, the distance 170 at each axial position may be particularly configured to redirect fluid flow near an adjacent vane 40, thereby decreasing the incidence angle between the fluid flow and the vane 40. As will be appreciated, such a configuration may increase the overall efficiency of a diffuser 24 employing both vanes 40 and vanelets 134-154. In the present embodiment, the distance 170 increases as distance from the vanelet root 162 increases. Alternative embodiments may employ other leading edge profiles, including arrangements in which the leading edge 156 extends past the reference line 168 along a direction toward the impeller 12.

Similarly, a circumferential position of the trailing edge 158 may be configured to vary along the span 48 of the vanelet 134. As illustrated, a reference line 172 extends from the trailing edge 158 of the vanelet tip 160 toward the shroud-side mounting surface 34 along the axial direction 20. The circumferential position of the trailing edge 158 along the span 48 is offset from the reference line 172 by a variable distance 174. In other words, the trailing edge 158 is variable rather than constant in the circumferential direction 16. This configuration establishes a variable distance between the impeller 12 and the trailing edge 158 of the vanelet 134 along the span 48. For example, based on computer simulation of fluid flow from the impeller 12, a particular distance 174 may be selected for each axial position along the span 48. In this manner, efficiency of the vanelet 134 may be increased compared to configurations employing a constant distance 174. In addition, the distance 174 at each axial position may be particularly configured to redirect fluid flow near an adjacent vane 40, thereby decreasing the incidence angle between the fluid flow and the vane 40. As will be appreciated, such a configuration may increase the overall efficiency of a diffuser 24 employing both vanes 40 and vanelets 134-154. In the present embodiment, the distance 174 increases as distance from the vanelet root 162 increases. Alternative embodiments may employ other trailing edge profiles, including arrangements in which the trailing edge 158 extends past the reference line 172 along a direction away from the impeller 12. In further embodiments, a radial position of the leading edge 156 and/or a radial position of the trailing edge 158 may vary along the span 48 of the vanelet 134.

Figure 13:
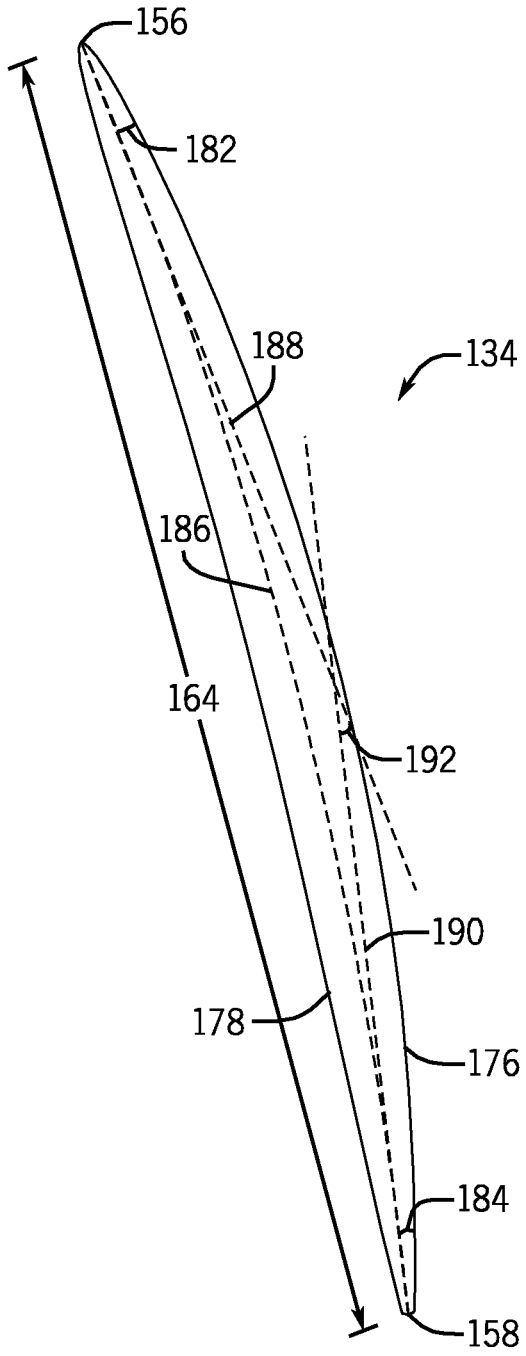
FIG. 13 is a top view of a diffuser vanelet, taken along line 13-13 of FIG. 12, in accordance with certain embodiments of the present technique.

FIG. 13 is a top view of the exemplary diffuser vanelet 134, taken along line 13-13 of FIG. 12. As previously discussed, a profile of the vanelet 134 may vary along the axial direction 20, thereby establishing a three-dimensional vanelet shape. Specifically, parameters of the vanelet 134 may be particularly configured to coincide with three-dimensional fluid flow from a particular impeller 12, thereby efficiently converting fluid velocity into fluid pressure. For example, as previously discussed, the meridional length for an axial position (i.e., position along the axial direction 20) of the vanelet 134 may be selected based on the flow properties at that axial location. As illustrated, the length 164 of the vanelet tip 160 may be selected based on the flow from the impeller 12 at the tip 160 of the vanelet 134.

Furthermore, the leading edge 156 and/or the trailing edge 158 may include a curved profile at the tip of the respective edge. Specifically, a tip of the leading edge 156 may include a curved profile having a radius of curvature 182 configured to direct fluid flow around the leading edge 156. Similarly, a radius of curvature 184 of a tip of the trailing edge 158 may be selected based on computed flow properties at the trailing edge 158. In certain configurations, the radius of curvature 182 of the leading edge 156 may be larger than the radius of curvature 184 of the trailing edge 158. In alternative configurations, the radius of curvature 182 of the leading edge 156 may be smaller than the radius of curvature 184 of the trailing edge 158.

Another vane property that may affect fluid flow through the diffuser 24 is the curvature of the vanelet 134. As illustrated, a mean vanelet sectional line 186 extends from the leading edge 156 to the trailing edge 158 and defines the center of the vanelet profile (i.e., the center line between the pressure surface 176 and the suction surface 178). The mean vanelet sectional line 186 illustrates the curved profile of the vanelet 134. Specifically, a leading edge tangent line 188 extends from the leading edge 156 and is tangent to the mean vanelet sectional line 186 at the leading edge 156. Similarly, a trailing edge tangent line 190 extends from the trailing edge 158 and is tangent to the mean vanelet sectional line 186 at the trailing edge 158. A curvature angle 192 is formed at the intersection between the tangent line 188 and tangent line 190. As illustrated, the larger the curvature of the vanelet 134, the larger the curvature angle 192. Therefore, the angle 192 provides an effective measurement of the curvature of the vanelet 134. The curvature angle 192 may be selected to provide an efficient conversion from dynamic head to pressure head based on flow properties from the impeller 12. In addition, the curvature angle 192 may be selected to redirect fluid flow near an adjacent vane 40 to decrease an incidence angle between the fluid flow and the leading edge of the vane 40. As will be appreciated, such a configuration may increase the efficiency of diffuser configurations which employ both vanes 40 and vanelets 134-154. For example, the curvature angle 192 may be greater than approximately 0, 5, 10, 15, 20, 25, 30, or more degrees.

The curvature angle 192, the radius of curvature 182 of the leading edge 156, the radius of curvature 184 of the trailing edge 158 and/or the length 164 may vary along the span 48 of the vanelet 134. Specifically, each of the above parameters may be particularly selected for each axial cross section based on computed flow properties at the corresponding axial location. In this manner, a three-dimensional vanelet 134 (i.e., a vanelet 134 having a variable cross section geometry or profile) may be constructed that provides increased efficiency compared to a two-dimensional vane (i.e., a vane having a constant cross section geometry).

Figure 14:
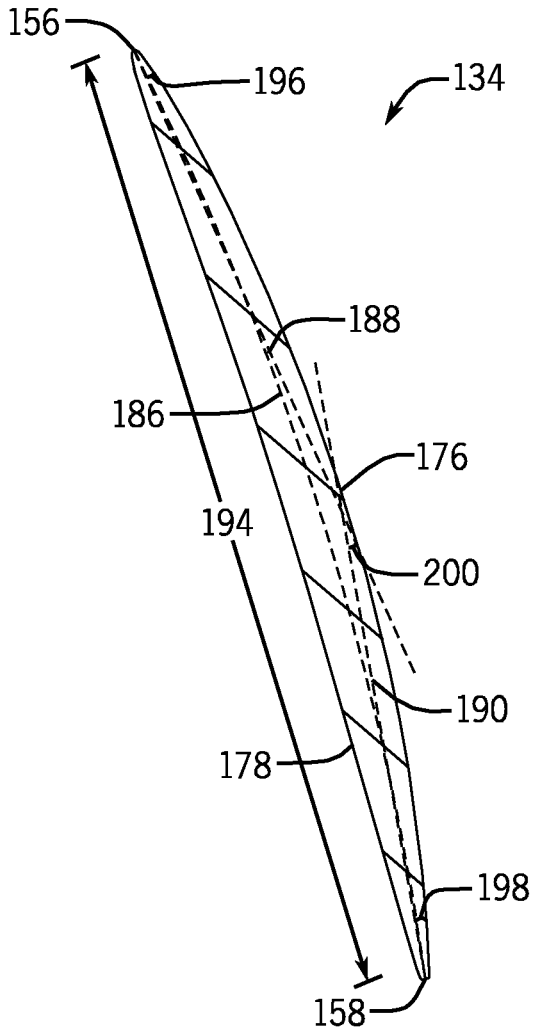
FIG. 14 is a cross section of a diffuser vanelet, taken along line 14-14 of FIG. 12, in accordance with certain embodiments of the present technique.

FIG. 14 is a cross section of the exemplary diffuser vanelet 134, taken along line 14-14 of FIG. 12. As illustrated, the profile of the vanelet 134 has been altered to coincide with the flow properties at the axial location corresponding to the present section. For example, the meridional length 194 of the present section may vary from the length 164 of the vanelet tip 160. Similarly, a radius of curvature 196 of the leading edge 156, a radius of curvature 198 of the trailing edge 158, and/or the curvature angle 200 may vary between the illustrated section and the section shown in FIG. 13. For example, the radius of curvature 196 of the leading edge 156 may be particularly selected to reduce the incidence angle between the fluid flow from the impeller 12 and the leading edge 156. As previously discussed, the angle of the fluid flow from the impeller 12 may vary along the axial direction 20. Because the present embodiment facilitates selection of a radius of curvature 196 at each axial position (i.e., position along the axial direction 20), the incidence angle may be substantially reduced along the span 48 of the vanelet 134, thereby increasing the efficiency of the vanelet 134 compared to configurations in which the radius of curvature 196 of the leading edge 156 remains substantially constant throughout the span 48. In addition, because the velocity of the fluid flow from the impeller 12 may vary in the axial direction 20, adjusting the radii of curvature 196 and 198, the length 194, curvature angle 200, or other parameters for each axial section of the vanelet 134 may facilitate increased efficiency of the entire diffuser 24. For example, in configurations which employ both vanes 40 and vanelets 134-154, the parameters of each axial section may be particularly configured to redirect fluid flow near an adjacent vane 40, thereby reducing an incidence angle between the fluid flow and a leading edge of the vane. As will be appreciated, adjusting flow to match the angle of the vane 40 increases efficiency of the vane 40, which may result in an overall increase in diffuser efficiency.

Figure 15:
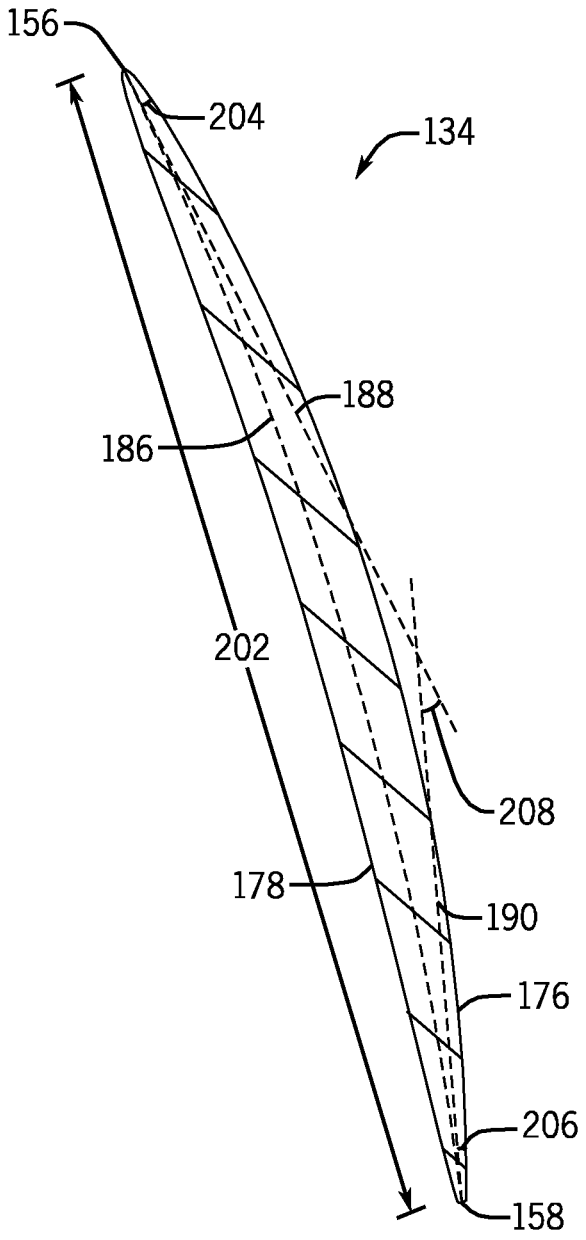
FIG. 15 is a cross section of a diffuser vanelet, taken along line 15-15 of FIG. 12, in accordance with certain embodiments of the present technique.

FIG. 15 is a cross section of the exemplary diffuser vanelet 134, taken along line 15-15 of FIG. 12. Similar to the section of FIG. 14, the profile of the present section is configured to match the flow properties at the corresponding axial location. Specifically, the present section includes a meridional length 202 that may vary from the lengths 164 and 194 of the sections shown in FIG. 13 and FIG. 14. In addition, a radius of curvature 204 of the leading edge 156, a radius of curvature 206 of the trailing edge 158, and a curvature angle 208 may also be particularly configured for the flow properties (e.g., velocity, incidence angle, etc.) at the present axial location. As previously discussed, the variation in vane profile along the axial direction establishes a three-dimensional vanelet 134 substantially configured to match the flow field from the impeller 12. Consequently, the present configuration may provide increased diffuser efficiency compared to embodiments employing two-dimensional vanelets and no vanes. In certain embodiments, the vanelets 134-154 may be configured to redirect the flow from the impeller 12 to reduce the incidence angle between the fluid flow and the leading edge 52 of the vane 40, thereby increasing diffuser efficiency.

Figure 16:
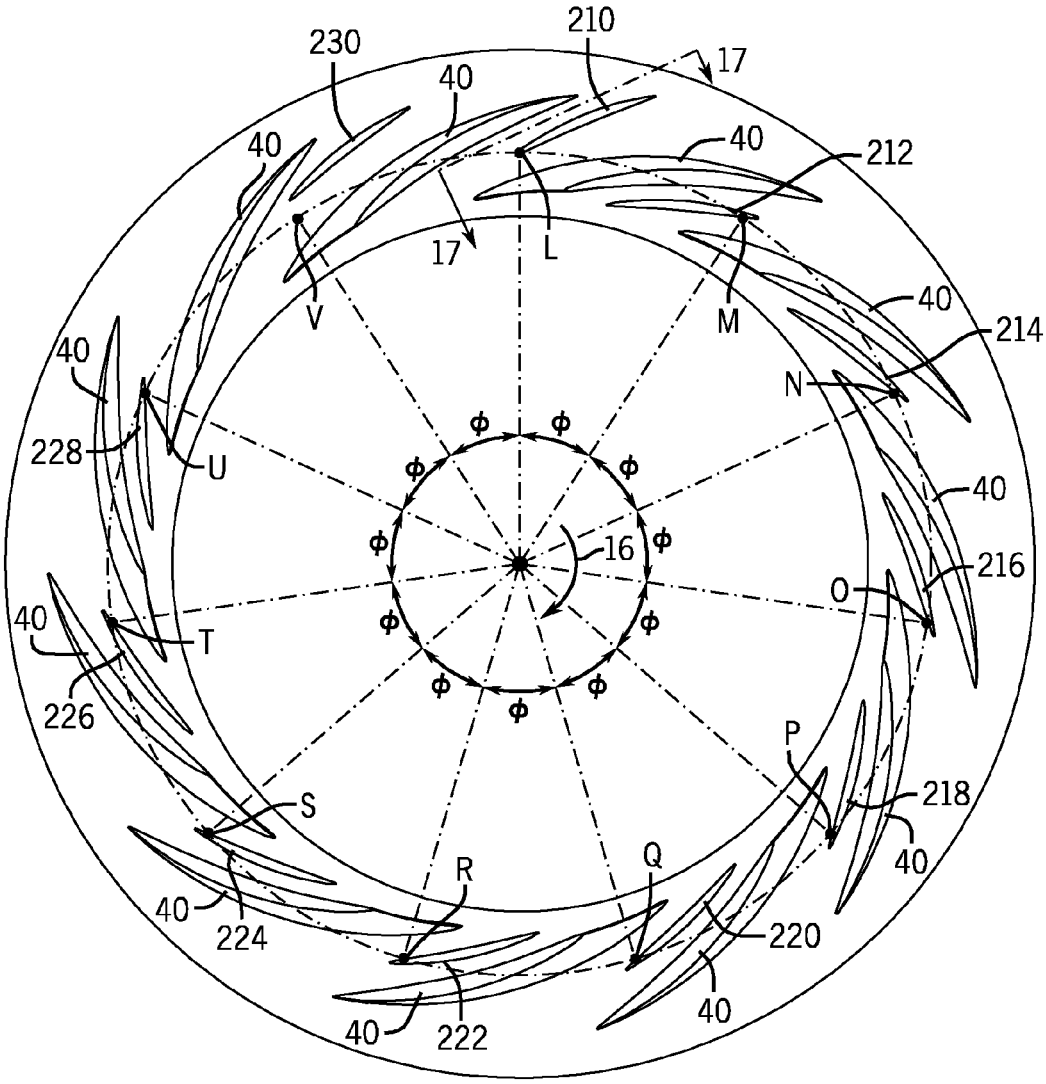
FIG. 16 is an axial view of a further embodiment of the diffuser, in which the vanelets are arranged in a non-periodic configuration and have a profile that remains constant along an axial direction in accordance with certain embodiments of the present technique.

FIG. 16 is an axial view of a further embodiment of the diffuser, in which the vanelets are arranged in a non-periodic configuration and have a profile that remains constant along the axial direction. Because the vanelet profile does not vary along the axial direction, the presently illustrated vanelets may be considered two-dimensional. As illustrated, the present embodiment employs vanes 40 having a three-dimensional shape. However, it should be appreciated that alternative embodiments may include two-dimensional vanes, or a combination of two-dimensional and three-dimensional vanes 40. Similar to the three-dimensional vanelets described above, the two-dimensional vanelets of the present embodiment are configured to redirect fluid flow from the impeller 12, thereby reducing an incidence angle between the fluid flow and a leading edge of an adjacent vane 40. As previously discussed, reducing the incidence angle associated with each vane 40 increases the overall efficiency of the diffuser 24.

Similar to the non-periodic configuration described above with regard to FIG. 11, the present diffuser 24 includes vanelets 210, 212, 214, 216, 218, 220, 222, 224, 226, 228 and 230 arranged in a non-periodic (e.g., an asymmetrical) pattern along the circumferential direction 16. As previously discussed, any set of vanelets that does not meet the circumferentially symmetric transformation requirement described above is considered to be non-periodic. To illustrate the nature of the non-periodic (e.g., an asymmetrical) pattern illustrated in FIG. 16, reference points L, M, N, O, P, Q, R, S, T, U and V are located at equally spaced circumferential locations around the shroud-side mounting surface 34. As illustrated, the diffuser 24 includes 11 vanelets 210-230. As such, the reference points L, M, N, O, P, Q, R, S, T, U and V are equally spaced at arc angles Φ of 32.73 degrees (e.g., 360.0 degrees divided by 11).

Each of the illustrated vanelets 210, 212, 214, 216, 218, 220, 222, 224, 226, 228 and 230 are generally associated with one of the reference points L, M, N, O, P, Q, R, S, T, U and V (e.g., vanelet 210 with reference point L, vanelet 212 with reference point M, vanelet 214 with reference point N, vanelet 216 with reference point O, vanelet 218 with reference point P, vanelet 220 with reference point Q, vanelet 222 with reference point R, vanelet 224 with reference point S, vanelet 226 with reference point T, vanelet 228 with reference point U and vanelet 230 with reference point V). The reference points L, M, N, O, P, Q, R, S, T, U and V are used to illustrate how the shape, orientation, and/or location of the vanelets 210-230 may change from vanelet to vanelet along the circumferential direction 16 of the shroud-side mounting surface 34.

More specifically, as described above, in order to be considered a periodic (e.g., symmetrical) arrangement of vanelets, for every point that lies within the two-dimensional domain of a vanelet (e.g., a reference vanelet 210) reference plane, the rotation of the point by 32.73 degrees, 65.46 degrees, 98.19 degrees, 130.92 degrees, 163.65 degrees, 196.38 degrees, 229.11 degrees, 261.84 degrees, 294.57 and 327.30 degrees (e.g., integer multiples of 360.0 degrees divided by 11, or 32.73 degrees) would yield a point that lies within the two-dimensional domain of the reference plane of the other vanelets 212, 214, 216, 218, 220, 222, 224, 226, 228 and 230. However, as illustrated, reference points M, N, O, P, Q, R, S, T, U and V, which correspond to reference point A rotated through arc angles of 32.73 degrees, 65.46 degrees, 98.19 degrees, 130.92 degrees, 163.65 degrees, 196.38 degrees, 229.11 degrees, 261.84 degrees, 294.57 and 327.30 degrees, do not all lie within the two-dimensional domain of the reference plane for the other vanelets 212, 214, 216, 218, 220, 222, 224, 226, 228 and 230. For example, reference point V does not even lie within the corresponding vanelet 230. As such, the vanelets 210-230 are arranged in a non-periodic configuration within the diffuser 24.

Figure 17:
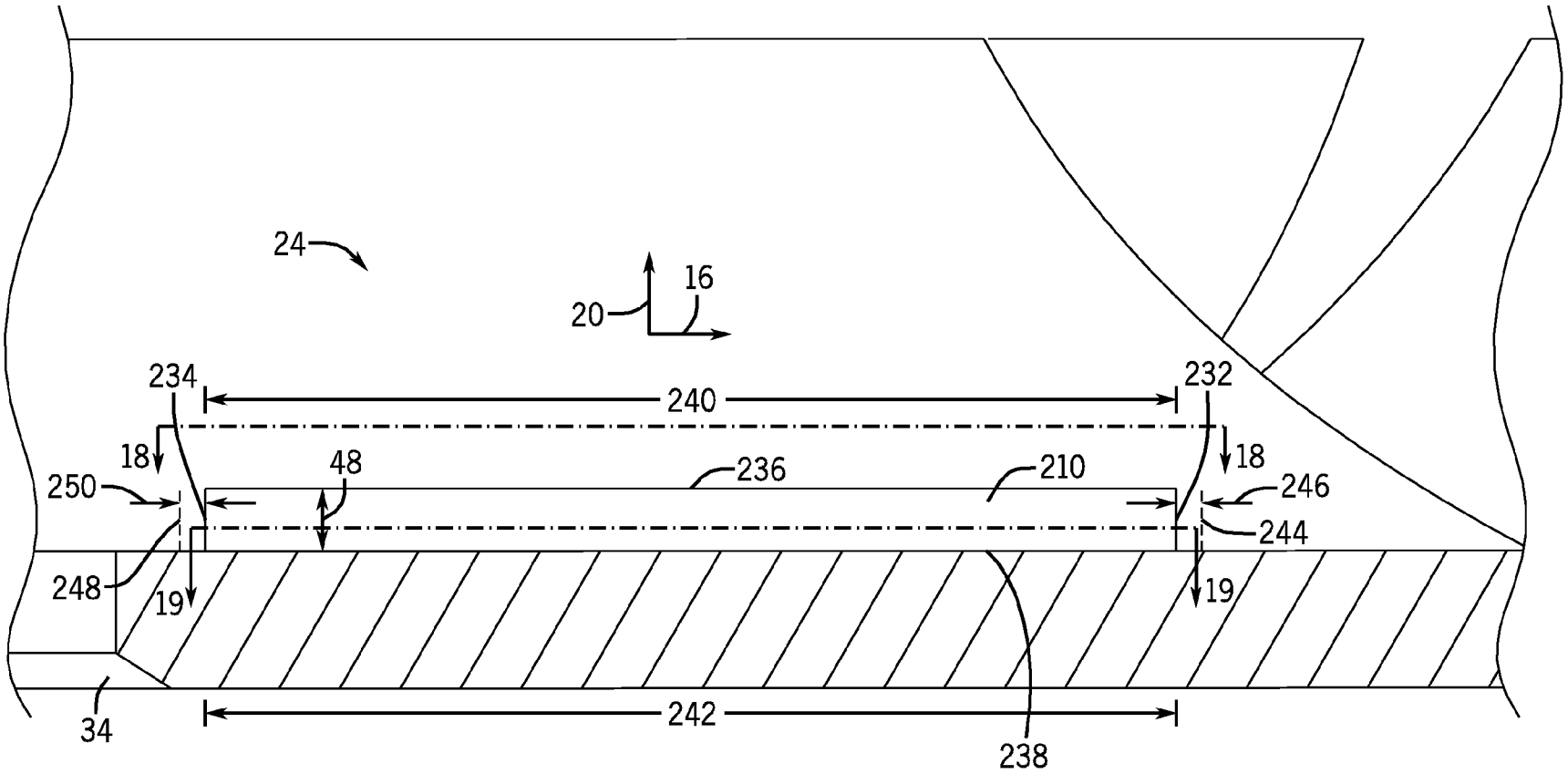
FIG. 17 is a meridional view of the diffuser, taken along line 17-17 of FIG. 16, depicting a diffuser vanelet profile in accordance with certain embodiments of the present technique.

FIG. 17 is a meridional view of the diffuser, taken along line 17-17 of FIG. 16, depicting a diffuser vanelet profile. In contrast to the diffuser 24 of FIG. 11, the vanelets 210-230 of the present diffuser 24 include cross-sectional profiles that remain constant along the axial direction 20, thereby establishing a two-dimensional shape. Each vanelet 210-230 extends along the axial direction 20 from the shroud-side mounting surface 34 toward the hub-side mounting surface 36. As previously discussed, the axial extent or span 48 of the vanelets 210-230 is less than the axial extent 46 of the diffuser flow path 32. Furthermore, while an exemplary vanelet 210 is shown extending from the shroud-side mounting surface 34, it should be appreciated that alternative embodiments may include vanelets which extend from the hub-side mounting surface 36. In further embodiments, a diffuser may include vanelets extending from both the shroud-side mounting surface 34 and the hub-side mounting surface 36. While the discussion below describes the shape of an exemplary vanelet 210 of the diffuser 24 shown in FIG. 16, it should be appreciated that the other vanelets 212-230 may have a similar shape. However, in certain configurations, the shape of the vanelets 210-230 may vary based on circumferential position of the respective vanelet.

As illustrated, the span 48 is defined by a vanelet tip 236 on the hub side and a vanelet root 238 on the shroud side. As discussed in detail below, a meridional length of the vanelet 210 does not vary along the span 48 because the vanelet is two-dimensional. The meridional length is the distance between the leading edge 232 and the trailing edge 234 at a particular axial position along the vanelet 210. In the present embodiment, the length of the vanelet 210 remains constant. For example, a meridional length 240 of the vanelet tip 236 is substantially the same as a meridional length 242 of the vanelet root 238.

In addition, a circumferential position (i.e., position along the circumferential direction 16) of the leading edge 232 and/or trailing edge 234 does not vary along the span 48 of the vanelet 210. As illustrated, a reference line 244 extends from the vanelet root 238 to the hub side axial extent of the vanelet 210. The circumferential position of the leading edge 232 along the span 48 is offset from the reference line 244 by a constant distance 246. Similarly, a circumferential position of the trailing edge 234 does not vary along the span 48 of the vanelet 210. As illustrated, a reference line 248 extends from the vanelet tip 236 toward the shroud-side mounting surface 34 along the axial direction 20. The circumferential position of the trailing edge 234 along the span 48 is offset from the reference line 248 by a constant distance 250. Because the length and the circumferential position of the leading edge 232 and trailing edge 234 remain substantially constant, the design and manufacturing costs associated with vanelet production may be substantially less than the three-dimensional configurations described above. Furthermore, such two-dimensional vanelets 210-230 may provide increased diffuser efficiency by redirecting fluid flow near an adjacent vane 40, thereby decreasing the incidence angle between the vane 40 and the fluid flow.

Figure 18:
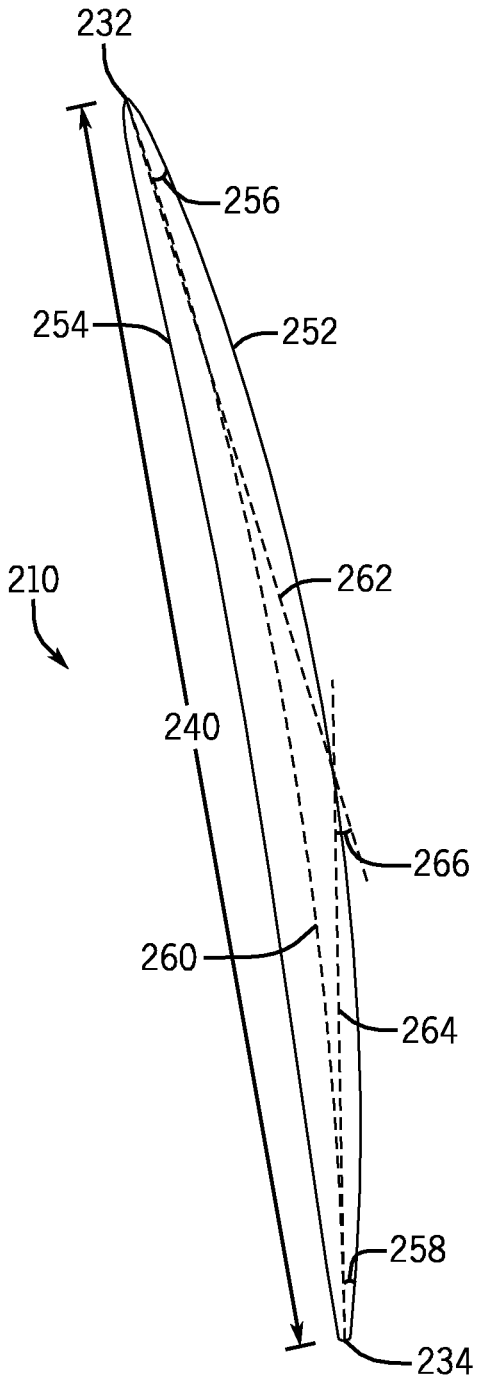
FIG. 18 is a top view of a diffuser vanelet, taken along line 18-18 of FIG. 17, in accordance with certain embodiments of the present technique.

FIG. 18 is a top view of the exemplary diffuser vanelet 210, taken along line 18-18 of FIG. 17. As previously discussed, a profile of the vanelet 210 remains constant along the axial direction 20, thereby establishing a two-dimensional vanelet shape. For example, as previously discussed, the meridional length may be the same for each axial position (i.e., position along the axial direction 20) of the vanelet 210. As illustrated, the leading edge 232 and/or the trailing edge 234 include a curved profile at the tip of the respective edge. Specifically, a tip of the leading edge 232 may include a curved profile having a radius of curvature 256 configured to direct fluid flow around the leading edge 232. Similarly, a radius of curvature 258 of a tip of the trailing edge 234 may be selected based on computed flow properties at the trailing edge 234. In certain configurations, the radius of curvature 256 of the leading edge 232 may be larger than the radius of curvature 258 of the trailing edge 234. In alternative configurations, the radius of curvature 256 of the leading edge 232 may be smaller than the radius of curvature 258 of the trailing edge 234.

Another vane property that may affect fluid flow through the diffuser 24 is the curvature of the vanelet 210. As illustrated, a mean vanelet sectional line 260 extends from the leading edge 232 to the trailing edge 234 and defines the center of the vanelet profile (i.e., the center line between the pressure surface 252 and the suction surface 254). The mean vanelet sectional line 260 illustrates the curved profile of the vanelet 210. Specifically, a leading edge tangent line 262 extends from the leading edge 232 and is tangent to the mean vanelet sectional line 260 at the leading edge 232. Similarly, a trailing edge tangent line 264 extends from the trailing edge 232 and is tangent to the mean vanelet sectional line 260 at the trailing edge 234. An curvature angle 266 is formed at the intersection between the tangent line 262 and tangent line 264. As illustrated, the larger the curvature of the vanelet 210, the larger the curvature angle 266. Therefore, the angle 266 provides an effective measurement of the curvature of the vanelet 210. The curvature angle 266 may be selected to provide an efficient conversion from dynamic head to pressure head based on flow properties from the impeller 12. In addition, the curvature angle 266 may be selected to redirect fluid flow near an adjacent vane 40 to decrease an incidence angle between the fluid flow and the leading edge of the vane 40. As will be appreciated, such a configuration may increase the efficiency of the diffuser 24. For example, the curvature angle 266 may be greater than approximately 0, 5, 10, 15, 20, 25, 30, or more degrees.

The curvature angle 266, the radius of curvature 256 of the leading edge 232, the radius of curvature 258 of the trailing edge 234 and the length 240 remain constant along the span 48 of the vanelet 210. In this manner, a two-dimensional vanelet 210 (i.e., a vanelet 210 having a constant cross section geometry or profile) may be constructed that provides increased efficiency compared to diffuser configurations without vanelets. As previously discussed, the two-dimensional vanelet configuration may reduce diffuser design and manufacturing costs, while providing increased diffuser efficiency.

Figure 19:
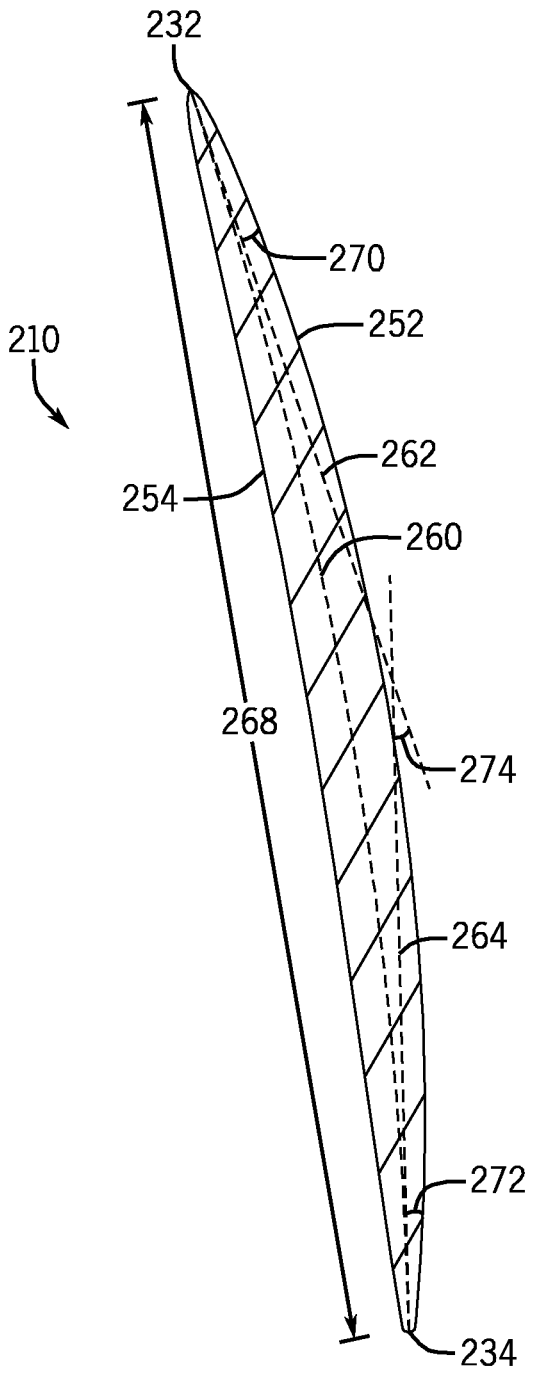
FIG. 19 is a cross section of a diffuser vanelet, taken along line 19-19 of FIG. 17, in accordance with certain embodiments of the present technique.

FIG. 19 is a cross section of the exemplary diffuser vanelet 210, taken along line 19-19 of FIG. 17. As illustrated, the profile of the vanelet 210 is substantially the same as the profile illustrated in FIG. 18. For example, the meridional length 268 of the present section is equal to the length 240 of the vanelet tip 236. Similarly, a radius of curvature 270 of the leading edge 232, a radius of curvature 272 of the trailing edge 234, and the curvature angle 274 does not vary between the illustrated section and the section shown in FIG. 18. Because the profile of the vanelet 210 remains substantially constant along the axial direction, the vanelet 210 has a two-dimensional shape. As a result, the vanelets 210-230 may be less expensive to design and manufacture than three-dimensional vanelet configurations.

As will be appreciated, the vanelets described above may be employed within various diffuser configurations. For example, the diffuser 24 described with reference to FIG. 3 includes periodic, three-dimensional vanes and periodic, three-dimensional vanelets. In addition, the diffuser 24 described with reference to FIG. 11 includes non-periodic, three-dimensional vanelets, and no vanes. Furthermore, the diffuser 24 described with reference to FIG. 16 includes periodic, three-dimensional vanes and non-periodic, two-dimensional vanelets. As will be appreciated, other combinations of vanes and vanelets may be employed within other embodiments. For example, certain embodiments may include non-periodic, two-dimensional vanelets, and no vanes. Further embodiments may include non-periodic, two-dimensional vanelets and two-dimensional vanes (either periodic or non-periodic). Yet further embodiments may include two-dimensional vanes (either periodic or non-periodic) and three-dimensional vanelets (either periodic or non-periodic). Other possible combinations of vanes and vanelets may be employed in alternative embodiments.

While the invention may be susceptible to various modifications and alternative forms, specific embodiments have been shown by way of example in the drawings and have been described in detail herein. However, it should be understood that the invention is not intended to be limited to the particular forms disclosed. Rather, the invention is to cover all modifications, equivalents, and alternatives falling within the spirit and scope of the invention as defined by the following appended claims.

The invention claimed is:

1. A system, comprising:

a diffuser, comprising:

a plurality of vanes circumferentially spaced about a central axis in a first arrangement; and a plurality of vanelets circumferentially spaced about the central axis in a second arrangement, wherein the first arrangement of the plurality of vanes is a first non-periodic arrangement, the second arrangement of the plurality of vanelets is a second non-periodic arrangement, or a combination thereof; and wherein the diffuser has at least one of:

a vanelet height of at least one vanelet of the plurality of vanelets is less than one half of a vane height of at least one vane of the plurality of vanes; or a vanelet length of at least one vanelet of the plurality of vanelets is greater than one half of a vane length of at least one vane of the plurality of vanes; or a leading edge of at least one of the plurality of vanes or the plurality of vanelets is at least partially curved or completely non-parallel in an axial direction along the central axis; or a trailing edge of at least one of the plurality of vanes or the plurality of vanelets is at least partially curved or partially non-parallel in the axial direction along the central axis; or a portion of a cross-sectional profile of at least one of the plurality of vanes or the plurality of vanelets changes in the axial direction along the central axis;

or any combination thereof.

2. The system of claim 1, wherein the vanelet height of at least one vanelet of the plurality of vanelets is less than one half of the vane height of at least one vane of the plurality of vanes.

3. The system of claim 1, wherein the vanelet height of at least one vanelet of the plurality of vanelets is less than 40 percent of the vane height of at least one vane of the plurality of vanes.

4. The system of claim 1, wherein the vanelet height of at least one vanelet of the plurality of vanelets is less than 30 percent of the vane height of at least one vane of the plurality of vanes.

5. The system of claim 1, wherein the vanelet length of at least one vanelet of the plurality of vanelets is greater than one half of the vane length of at least one vane of the plurality of vanes.

6. The system of claim 1, wherein the leading edge of at least one of the plurality of vanes or the plurality of vanelets is at least partially curved or completely non-parallel in the axial direction along the central axis.

7. The system of claim 1, wherein the leading edge of at least one vanelet of the plurality of vanelets is at least partially curved in the axial direction along the central axis.

8. The system of claim 1, wherein the leading edge of at least one vane of the plurality of vanes is at least partially curved in the axial direction along the central axis.

9. The system of claim 1, wherein the leading edge of at least one of the plurality of vanes or the plurality of vanelets is completely non-parallel in the axial direction along the central axis.

10. The system of claim 1, wherein the trailing edge of at least one of the plurality of vanes or the plurality of vanelets is at least partially curved or partially non-parallel in the axial direction along the central axis.

11. The system of claim 1, wherein the trailing edge of at least one vanelet of the plurality of vanelets is at least partially curved in the axial direction along the central axis.

12. The system of claim 1, wherein the trailing edge of at least one vane of the plurality of vanes is at least partially curved in the axial direction along the central axis.

13. The system of claim 1, wherein the portion of the cross-sectional profile of at least one of the plurality of vanes or the plurality of vanelets changes in the axial direction along the central axis.

14. The system of claim 13, wherein the portion comprises at least one half a length of the cross-sectional profile.

15. The system of claim 1, wherein the portion of the cross-sectional profile of at least one vanelet of the plurality of vanelets changes in the axial direction along the central axis via a changing curvature of a centerline of the cross-sectional profile, a changing angle between first and second portions of the centerline of the cross-sectional profile, or a combination thereof.

16. The system of claim 1, wherein the portion of the cross-sectional profile of at least one vane of the plurality of vanes changes in the axial direction along the central axis via a changing curvature of a centerline of the cross-sectional profile, a changing angle between first and second portions of the centerline of the cross-sectional profile, or a combination thereof.

17. The system of claim 1, comprising a compressor having the diffuser.

18. A system comprising:

a diffuser having a plurality of vanes and a plurality of diffuser vanelets, each of the diffuser vanelets having a vanelet height less than one half of a height of a diffuser flow path, wherein a portion of a cross-sectional profile of each of the diffuser vanelets changes in an axial direction of the height; wherein the plurality of vanes is a first non-periodic arrangement, the plurality of diffuser vanelets is a second non-periodic arrangement, or a combination thereof.

19. The system of claim 18, wherein the portion of the cross-sectional profile of the diffuser vanelet changes in the axial direction via a changing curvature of a centerline of the cross-sectional profile.

20. The system of claim 18, wherein the portion of the cross-sectional profile of the diffuser vanelet changes in the axial direction via a changing angle between first and second portions of a centerline of the cross-sectional profile.

21. A system, comprising:

a diffuser, comprising:

a plurality of vanes circumferentially spaced about a central axis m a first arrangement; and a plurality of vanelets circumferentially spaced about the central axis in a second arrangement, wherein a cross-sectional profile of at least one of the plurality of vanes or the plurality of vanelets changes in an axial direction along the central axis via a change in curvature or angle between different portions of the centerline;

wherein the plurality of vanes is a first non-periodic arrangement, the plurality of vanelets is a second non-periodic arrangement, or a combination thereof.

* * * * *